United States Patent [19]

Kosina et al.

[11] Patent Number: 4,457,656

[45] Date of Patent: Jul. 3, 1984

[54] STACK ASSEMBLING APPARATUS AND TECHNIQUE

[75] Inventors: Paul C. Kosina, Denver; George E. Koltko, Englewood, both of Colo.

[73] Assignee: Nolan Systems, Inc., Denver, Colo.

[21] Appl. No.: 230,018

[22] Filed: Jan. 30, 1981

[51] Int. Cl.[3] ..... B65G 57/03

[52] U.S. Cl. ..... 414/31; 271/273; 91/176; 104/37; 414/48; 414/65; 414/78

[58] Field of Search ..... 414/31, 45, 48, 49, 414/65, 66, 78, 79, 80, 97, 98, 695.5; 271/273, 274; 226/176, 177; 91/176; 104/35, 36, 37; 212/273

[56] References Cited

U.S. PATENT DOCUMENTS

| | | | |
|---|---|---|---|
| 2,205,767 | 7/1938 | Lamb | 271/215 |
| 3,245,557 | 4/1966 | Maramonte et al. | 414/66 X |
| 3,295,703 | 1/1967 | Schiepe | 414/79 X |
| 3,371,770 | 3/1968 | Graham et al. | 226/176 |
| 3,599,807 | 8/1971 | Hedrick et al. | 414/31 |
| 3,815,766 | 6/1974 | Carlson et al. | 414/695.5 |
| 4,068,567 | 1/1978 | Allison et al. | 414/31 |
| 4,279,413 | 7/1981 | Siwik et al. | 271/274 |
| 4,344,733 | 8/1982 | Hirsch | 414/695.5 X |

FOREIGN PATENT DOCUMENTS 706531 5/1941 Fed. Rep. of Germany ..... 104/36

*Primary Examiner*—Robert J. Spar
*Assistant Examiner*—Ken Muncy
*Attorney, Agent, or Firm*—Crandell & Polumbus

[57] ABSTRACT

Stack handling apparatus includes an input delivery section having two spaced apart conveyor segments operatively arranged to move equidistantly with respect to a centerline between the two conveyor segments. A stack formation section receives articles conveyed in a serial stream from the input delivery section and includes a carriage having a blade apparatus which is maintained at a generally constant predetermined angle as the carriage is transported in a closed loop transport movement path. Articles are assembled into batches on the blade apparatus, and each batch is transferred to door gate apparatus by relative linear movement. The door gate apparatus releases the batch for linear free fall movement to a turntable mechanism of a stack delivery section. The turntable mechanism alternately rotates 180° after the receipt of each batch. Longitudinally extendable hydraulic assemblies are eccentrically connected to rotate the turntable mechanism. Once complete, the assembled stack is ejected from the turntable mechanism.

19 Claims, 11 Drawing Figures

STACK ASSEMBLING APPARATUS AND TECHNIQUE

BACKGROUND OF THE INVENTION

This invention pertains to material handling, and more particularly to assembling a stack of flat sheet-like articles from a serial stream of such articles. The present invention has particular applicability in the newspaper industry and is intended for assembling a stack of newspapers from a predetermined counted number of newspapers advancing in a serial stream, and thereafter delivering the assembled stack to one or more conveyors. The stacks can thereafter be bound and shipped to the vendors as is the common practice in the newspaper industry, or otherwise handled.

Modern printing presses are capable of delivering completely finished newspapers at a rate approximating 90,000 newspapers per hour. The newspapers are delivered from the press on a conveyor in a serial stream. Vertical stacks of horizontal newspapers are immediately assembled from the serial stream from the press conveyor, and it is highly desirable to provide a stack assembling apparatus capable of operating at speeds equivalent to the maximum speed of the printing press. If the stack assembling apparatus is incapable of operating at the higher press speed, which is the case of many prior art machines, conveyor diverting equipment must be utilized in conjunction with plural stack assembling machines. Of course, it is desirable to avoid the additional expense of diverting equipment and stack assembling machines if possible.

Stack assembling machines are well known and have been utilized in the newspaper industry for many decades. Examples of prior art stack assembling machines are U.S. Pat. Nos. 3,599,807; 3,306,173; 3,083,014; 3,033,564; 3,088,604; 2,925,271; 2,884,246; 2,853,298; 2,815,210; 2,805,757; 2,795,420; 2,793,857; 2,788,131; 2,769,378; 2,733,064; 2,699,942; 2,697,602; 2,254,291; 2,205,767; 2,069,397; 1,586,544; 997,201; and 964,166.

In general, deficiencies in the prior art stack assembling machines reside primarily in an inability to operate accurately and reliably at speeds commensurate with modern high-speed printing presses. Many of the prior art stack assembling machines require elaborate and complicated mechanisms to perform the desired functions. Such elaborate mechanisms tend to decrease the reliability of operation when operated at increased speeds, although many prior stack assembling machines operate relatively satisfactorily at the lower press speeds typical of older printing presses. Attempts to increase the speed of such prior art stack assembling machines cause numerous problems including premature mechanical failure, an inability to form stacks of good integrity and shape, a tendency to damage certain newspapers during assembly of the stack, and an inability to accurately count predetermined numbers of newspapers into each stack. Many prior art stack assembling machines are capable of delivering the stacks of newspapers in only a single direction after the stacks have been assembled. Most newspaper printing operations in North and South America have been designed to receive the stacks of newspapers in a direction perpendicular to the supplied stream of newspapers from the printing press. In Europe and Asia, most newspaper printing operations require that the stacks be delivered parallel to the supplied stream of newspapers from the printing press. With these diverse requirements, two distinct types of stack handling machines have previously been required because the structure of most prior stack assembling machines could not be readily adapted to deliver the stacks from the perpendicular direction to the parallel direction, or vice versa. Other problems of prior art stack assembling machines are known to those involved in this field, and such problems and deficiencies will become more readily appreciated in view of the significant improvements available from the present invention.

SUMMARY OF THE INVENTION

It is the primary objective of the present invention to provide a new and improved stack assembling apparatus and technique having the capability to improve on and solve many of the deficiencies common to prior art stack handling machines. More particularly, objectives of the present invention are to provide a new and improved stack handling apparatus and technique which is capable of reliably operating at increased speeds, which is capable of reliably and accurately counting a predetermined number of individual newspapers or sheet-like articles into each stack, which is capable of rapidly assembling the stack without signficantly damaging any of the newspapers or articles within the stack, which is capable of rapidly assembling a stack of relatively good shape and integrity, and which is readily adaptable to conveniently delivering the stacks in four directions parallel and perpendicular to the supplied stream of newspapers or articles.

In accordance with certain summary aspects, the present invention and technique involves an input delivery means which receives the supplied stream of articles and serially conveys and delivers each of the articles to a stack formation means. The stack formation means receives the articles and assembles a predetermined number of the articles into a layered batch. The layered batch is delivered from the stack formation means to a stack delivery means. The stack delivery means assembles a predetermined number of batches of articles into a stack and delivers or ejects the assembled stack.

The input delivery means includes, among other things, a pair of conveyor segments spaced on opposite sides of a centerline along which the articles are conveyed through the input delivery means. The conveyor segments are operatively connected to move equidistantly toward and away from the centerline. By moving the conveyor segments equidistantly with respect to the centerline, the trajectory and path followed by the articles through the input delivery means remains generally coincident with the predetermined centerline. Each of the articles is accurately positioned to reliably trigger an article counter mechanism. Missed and skipped counts are more effectively avoided and the end result is that the number of articles assembled into each stack becomes more accurate.

The stack formation means includes, among other things, carriage means which is moved in a closed figure transport movement path by a transport means. Each carriage means includes a blade apparatus which is operative to support the lowermost article of each batch and all of the remaining articles as they are received in a layered manner by movement of the carriage means relative to the trajectory of the articles as they are delivered from the input delivery section. The transport means includes elements operatively arranged for maintaining the blade apparatus at a generally constant and predetermined angular orientation during movement throughout the transport path. Means associated with the blade apparatus quickly moves it into a position for intercepting the first article of the next subsequent batch. The carriage means can be rapidly advanced, and batches can be a more rapidly assembled as a result. The assembled batches are delivered to and momentarily supported by door gate means. The door gate means releases the batch of articles to the stack delivery means after the blade apparatus of the carriage means has withdrawn horizontally from beneath the door gate means. By transferring the batch from the blade apparatus to the door gate means and releasing the batch by movement separate from the movement of the carriage means, there is no tendency to fan or distort the lower article of the batch as it is released. Release by the door gate means makes the movement of the carriage means somewhat independent of the operation of the stack delivery means, thereby allowing added flexibility in orienting and operating the elements of the stack delivery means to more effectively receive each batch. The formation and shape of the stacks is enhanced.

The stack delivery means includes, among other things, a turntable operative for receiving the batch delivered from the stack formation means. The turntable is rotated 180° after each additional batch is received, thereby avoiding lopsided stacks if one edge of the articles is thicker than the other. In order to rotate the turntable, hydraulic means operative for longitudinally extendable movement is operatively connected to a point on the turntable eccentrically positioned with respect to a rotational axis of the turntable. The application of force to the hydraulic means is controlled to initially accelerate the rotational movement of the turntable from a first home position toward a second home position 180° rotationally displaced from the first home position, to thereafter decelerate the turntable as the turntable rotates into the second home position, and to lastly hold the turntable in the second home position. The turntable is rotated in this manner in alternate opposite directions. Ejector means removes the assembled stack from the turntable once the stack has been assembled from a predetermined number of batches. A relatively unobstructed open space is available to eject the assembled stacks from the stack delivery section in four directions along two mutually perpendicular movement paths. The unobstructed open space results primarily because of the arrangement of the transport means. By maintaining the support surface element at the generally constant predetermined angle throughout the movement path, the support surface element does not pivot into the open space and other elements of the transport means do not move into the open space to thereby obstruct the ability to deliver the assembled stacks in the selected directions.

A more detailed understanding of the inventive aspects of the present invention can be obtained from the appended claims, and from the following detailed description of a preferred embodiment of the invention taken in conjunction with drawings of the preferred embodiment.

BRIEF DESCRIPTION OF THE PREFERRED EMBODIMENT

Figure 1:
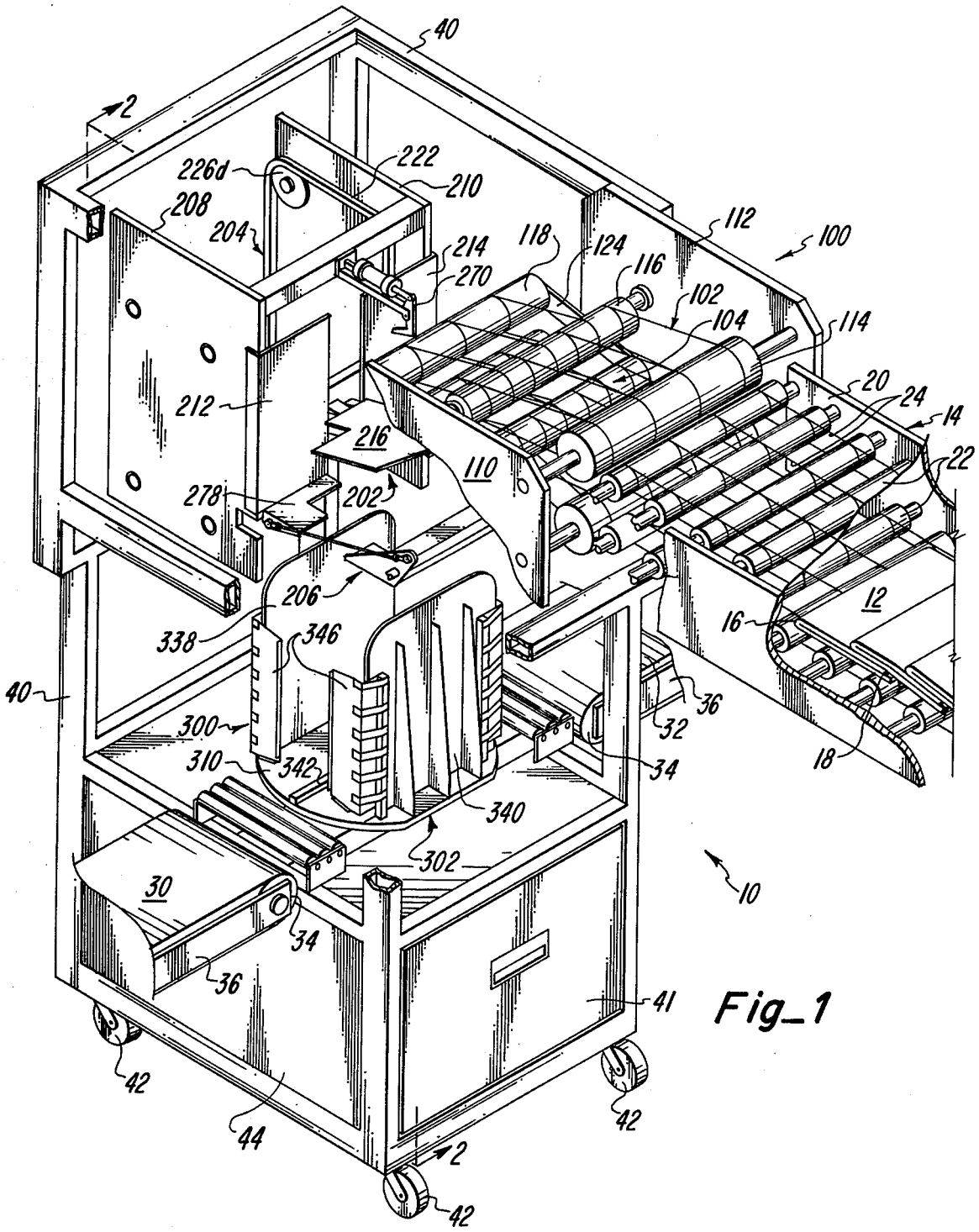
FIG. 1 is a generalized perspective view of a preferred embodiment of a stack assembling apparatus according to the present invention, including a segment of a press conveyor over which a stream of newspapers is delivered to the stack assembling apparatus and two segments of delivery conveyors from which the assembled stacks are transported away from the stack assembly apparatus.
Figure 2:
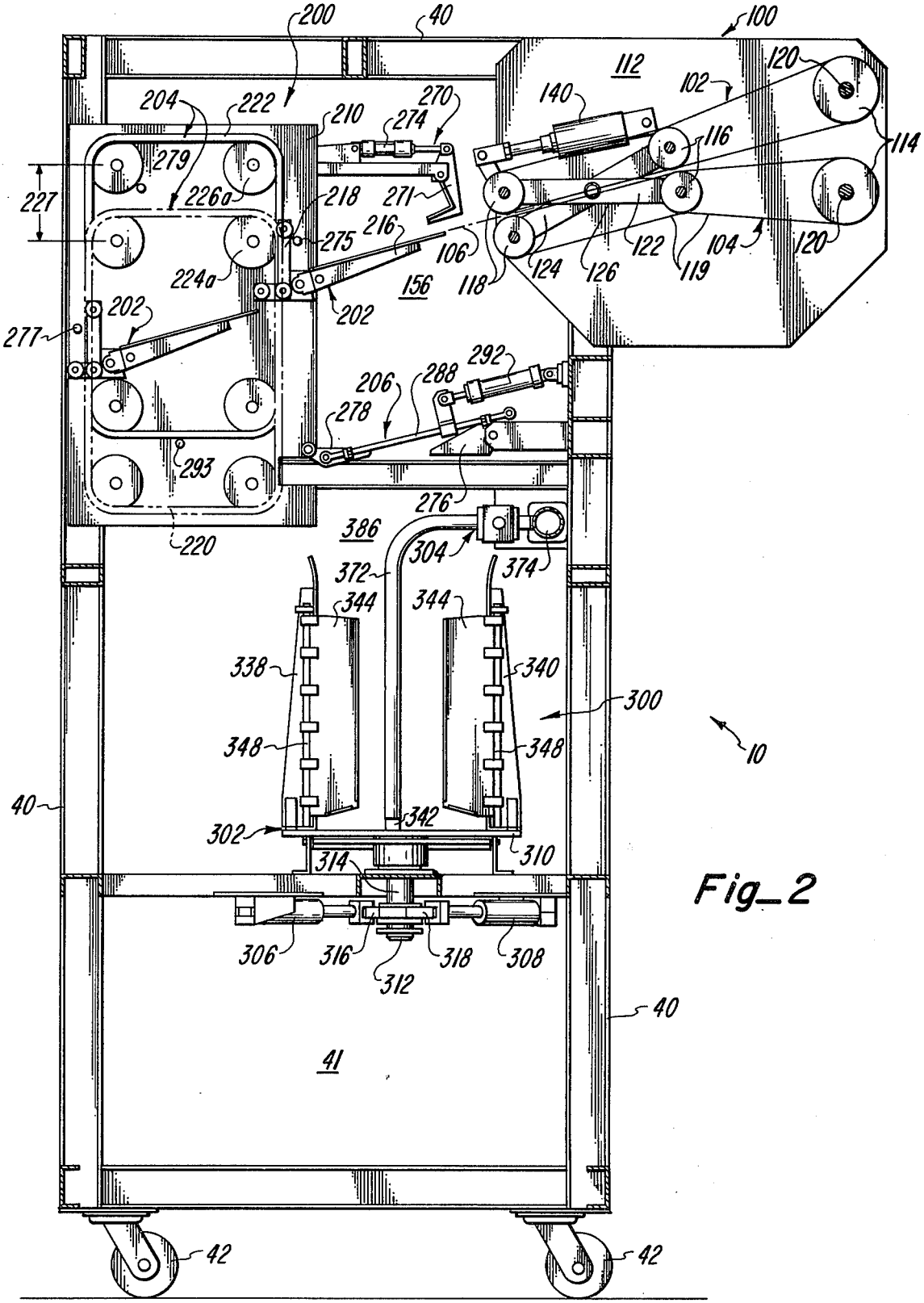
FIG. 2 is a vertical section view taken substantially in the plane of line 2—2 of FIG. 1.

A stack assembling apparatus 10 of the present invention is introduced by reference to FIGS. 1 and 2 as comprising an input delivery section 100, a stack formation section 200 and a stack delivery section 300. The input delivery section 100 receives newspapers 12 delivered from a printing press (not shown) over a press conveyor 14. The newspapers 12 are presented in a continuous serial stream with the folded edges 16 leading the trailing terminal free edges 18. The newspapers 12 are moved along the press conveyor 14 between a pair of vertically spaced wire conveyors 20 of conventional construction. Each wire conveyor 20 includes a plurality of cylindrical rollers 22 rotationally mounted at predetermined intervals along the length of the press conveyor 14. Wire belts 24 in the form of elongated helically coiled springs connect in unending loops between pairs of adjacent rollers 22. The tension characteristic of the wire belts 24 applies continual force on opposite sides of the stream of newspapers 12 and thereby holds the newspapers in serial aligned order as they are conveyed along the length of the press conveyor 14. The rollers 22 are rotationally connected by chains and sprockets (not shown) and are rotated by controllable variable-speed electric motors (also not shown), all of which is conventional in the newspaper industry.

Delivery conveyors 30 and 32 are positioned with respect to the stack assembling apparatus 10 to receive the assembled stacks of newspapers. The delivery conveyors 30 and 32 are shown in the configuration typical in newspaper printing operations in North and South America, because the delivery conveyors 30 and 32 extend approximately perpendicularly with respect to the press conveyor 14. In European and Asian newspaper printing operations the delivery conveyors are typically oriented parallel to the press conveyor 14. As will be seen, features of the apparatus 10 allow it to be quickly and conveniently adapted to deliver the newspaper stacks in directions perpendicular or parallel to the press conveyor 14. The delivery conveyors 30 and 32 are also of typical construction which employ a series of rollers 34 rotationally connected to a conveyor support structure 36. The rollers 34 present and define a generally smooth support and conveying surface for the stacks. Of course, the rollers 34 are mechanically linked for simultaneous rotation and are rotated by conventional means not specifically illustrated.

A frame structure 40 of the apparatus 10 retains the elements of the input delivery section 100, the stack formation section 200 and the stack delivery section 300 in an operative working relationship. In addition, the frame assembly 40 includes a lower compartment 41 which contains and houses elements of a control system 400, shown in FIGS. 10 and 11, used for controlling the operation of the components in sections 100, 200 and 300. Casters 42 are preferably connected to the frame structure 40. The casters 42 allow the stack assembly apparatus 10 to be transported and moved from one location to another and to be placed in proper position relative to the press conveyor 14 and the delivery conveyors 30 and 32. Exterior cover panels 44 are also attached to the frame structure 40 to conceal the majority of the elements of the apparatus 10. Of course, openings from the stack delivery section 300 to the delivery conveyors 30 and 32 are not obstructed by the exterior cover panels 44.

In general, the stack assembling apparatus 10 receives the stream of newspapers 12 from the press conveyor 14 at the input delivery section 100. The input delivery section 100 delivers the newspapers to the stack formation section 200. As the newspapers are delivered by the section 100, they are counted and the rate of delivery is determined. The stack formation section 200 receives the serially supplied individual newspapers and forms a vertically layered batch of the newspapers. The number of newspapers in each batch has been previously selected and once the predetermined number of newspapers have been received, the batch is transferred to the stack delivery section 300. The vertically layered batch is typically a fractional portion of the resulting stack, although the batch can also be the entire stack. It is desirable to form each newspaper stack from two or more batches of newspapers. Because each newspaper is generally slightly thicker along its folded edge 16 than along its terminal free edges 18, stacking newspapers with all of the folded edges 16 along one vertical side will result in a slightly lopsided or tilted stack. To avoid the resulting tendency toward instability, it is typical practice in the newspaper industry to alternate the position of the folded edges from one batch to another in the stack. The stack delivery section 300 has the capability to rotate the newspapers previously received 180° after each new batch is delivered. After a predetermined number of batches have been delivered, the stack is complete and is ejected from the section 300 onto one of the delivery conveyors 30 or 32. The delivery conveyors 30 and 32 transport each stack to its predetermined location for further handling.

Certain elements of the control system 400 are conveniently housed within a compartment 41 located within the frame structure 40 below the stack delivery section 300. Also included within the compartment 41 is an air compressor and compressed air reservoir which supply pressurized air to operate the various hydraulic assemblies employed.

Details of the nature and operation of the input delivery section 100, the stack formation section 200, the stack delivery section 300 and the control system 400 are described separately below.

Input Delivery Section

Figure 3:
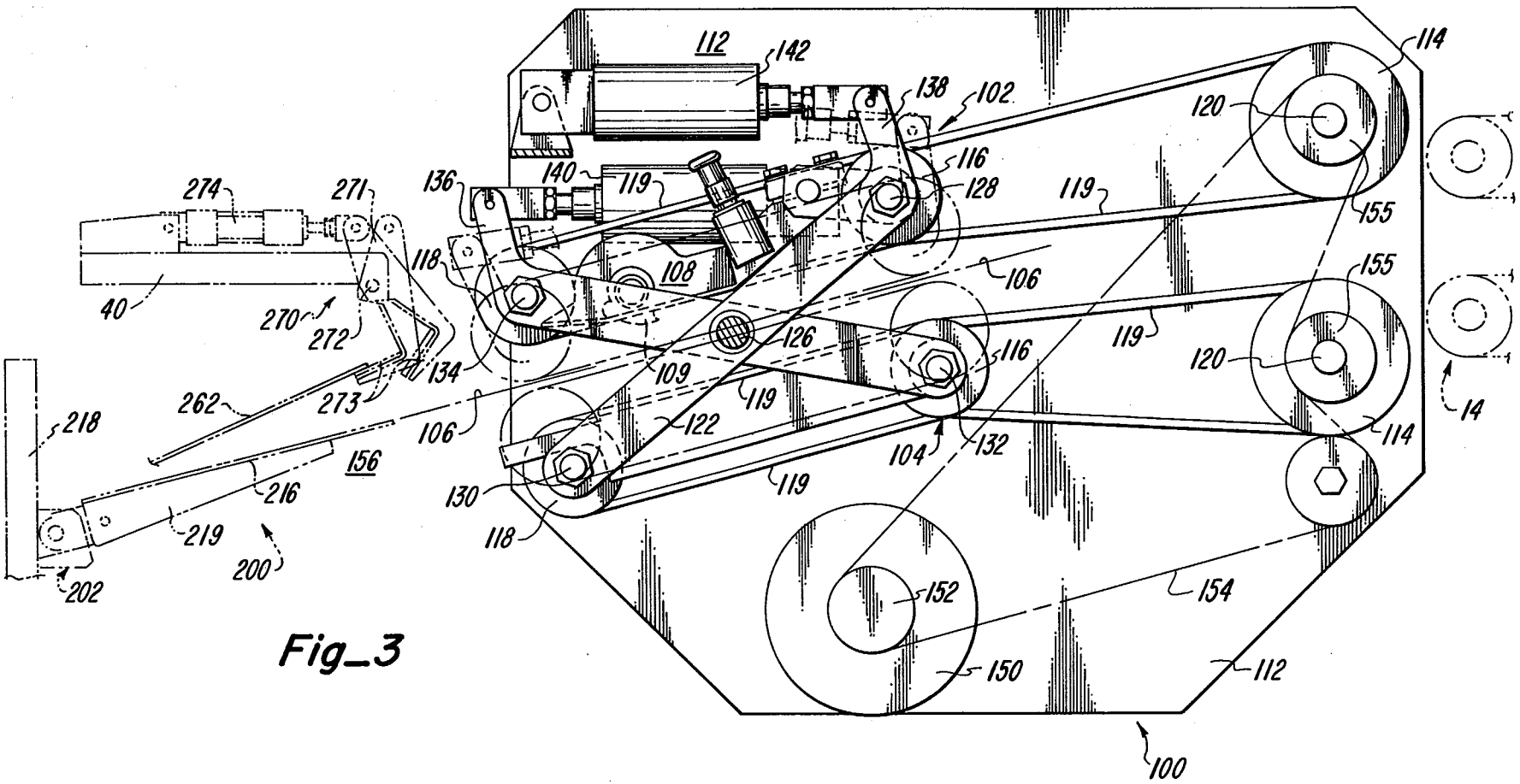
FIG. 3 is a side elevational view of the major elements of an input delivery section of the stack assembly apparatus shown in FIG. 1, including a blade apparatus and release mechanism of a stack formation section of the stack assembly apparatus shown in phantom.

The input delivery section 100 is seen in FIGS. 2 and 3 to comprise a pair of relatively short and vertically spaced wire belt conveyors 102 and 104. Portions of the conveyors 102 and 104 are operatively arranged to move toward one another equal distances relative to a centerline 106 between the conveyors 102 and 104. Upon moving toward the centerline 106 as shown by phantom lines in FIG. 3, the newspapers are pinched, firmly gripped and advanced along the centerline 106. The folded edges 16 of the newspapers 12 are maintained in a predetermined position relative to the centerline 106 that is the most advantageous for reliably activating a conventional counter mechanism 108. The counter mechanism 108 is triggered and provides a signal each time the leading folded edge 16 of each passing newspaper encounters and rotates a cog wheel 109 or triggering means of the counter mechanism.

The elements of the conveyors 102 and 104 and the counter mechanism 108 are operatively connected to a pair of laterally spaced side plates 110 and 112, and the side plates 110 and 112 are connected to the frame structure 40 of the apparatus 10. Each conveyor 102 and 104 includes a leading roller 114, a middle roller 116 and a terminal roller 118. The rollers 114, 116 and 118 are of the conventional, cylindrical drum-like construction, and adjacent pairs of rollers 114, 116 and 118 are connected by conventional looped wire belts 119. Each leading roller 114 is rotationally connected on an axle shaft 120 which extends between the side plates 110 and 112. The leading rollers 114 are thus rotationally fixed in rigid positions. The space between the leading rollers 114 of the conveyors 102 and 104 defines a constant height opening within which to receive the newspapers delivered from the press conveyor 14. The middle and terminal rollers 116 and 118 are, however, movably connected to the side plates 110 and 112 by means of a scissor assembly which moves the rollers 116 and 118 equidistantly toward one another relative to the centerline 106. The scissor assembly comprises a pair of pivot arms 122 and 124 on each lateral side of the rollers 116 and 118. The pivot arms 122 and 124 are pivotally connected to one another and to the side plates 110 and 112 at center pivot points 126 which are coincident with the centerline 106 at laterally spaced positions relative to the conveying path through the section 100. The middle roller 116 of the conveyor 102 and the terminal roller 118 of the conveyor 104 are rotationally connected on axle shafts 128 and 130, respectively, at or near the opposite ends of the pivot arm 122. The shafts 128 and 130 are connected to the laterally opposite pivot arms 122 in such a manner to define a rigid rectangular structure pivoted at 126. The middle roller 116 of conveyor 104 and the terminal roller 118 of conveyor 102 are rotationally connected on axle shaft 132 and 134, respectively, at or near the ends of the pivot arm 124. The shafts 132 and 134 are connected to the laterally opposite pivot arms 124 in such a manner to define a rigid rectangular structure pivoted at 126. The distances between the pivot point 126 and the axle shafts 128, 130, 132 and 134 are preferably equidistant. Projections 136 and 138 extend from the pivot arms 124 and 122 and are operatively connected to the plunger ends of conventional hydraulic cylinder assemblies 140 and 142, respectively. The other end of the hydraulic cylinders 140 and 142 are pivotably connected at stationary positions to the side plates 110 and 112.

Upon the application of force by the cylinder assemblies 140 and 142, which occurs continually during operation of the conveyors 102 and 104, the plunger end of the hydraulic assemblies extends slightly to pivot the pivot arms 122 and 124 about the point 126. The two middle rollers 116 move laterally toward the centerline 106 as a result of the pivoting movement, as do the two trailing rollers 118. Of course, the wire belts 119 looped between rollers 114 and 116 and between rollers 116 and 118 expand slightly because of their helical coil construction as the rollers 116 and 118 move relative to one another and relative to the leading rollers 114. The equal movement of the middle and trailing rollers toward the centerline 106 does not distort the flow path of newspapers relative to the centerline 106, and the leading folded edges 16 of the newspapers 12 maintain the same predetermined position relative to the counter mechanism 108 as the newspapers are firmly gripped. The performance of the counter mechanism 108 is more reliable and, as will be seen from the subsequent description, the signals supplied by the counter mechanism 108 accurately and reliably control the operation of the other elements of the apparatus 10.

The equal distance movement feature of the rollers 116 and 118 is a distinct advantage over the typical prior art arrangement. The typical prior art arrangement moves only one of two vertically spaced conveyors against the other stationary one of the conveyors. When the vertically movable conveyor is activated to grip the newspapers, the centerline of the movement of the newspapers is displaced slightly toward the direction that the movable conveyor moves. Displacement of the centerline moves the leading folded edge of the newspaper relative to the counter mechanism and typically adversely affects the performance of the counter mechanism. The usual result is miscounts in the numbers of newspapers delivered and imprecise control over the other elements of such prior art stack assembling machines.

The rollers 114, 116 and 118, and the wire belts 119 carried by the rollers are driven by a controllable, variable-speed motor 150. The motor 150 rotates a sprocket 152 which moves a chain 154 connected to sprockets 155 on the rollers 114. The wire belts 119 rotate the rollers 116 and 118 in unison with the rollers 114. The motor 150 is electrically connected by a conventional controller (not shown) to the motors of the press conveyor 14. The controller causes the motor 150 to rotate at a predetermined minimum speed so long as the speed of the press conveyor 14 is maintained below a fixed minimum speed. After the speed of the press conveyor 14 exceeds the fixed minimum speed, the speed of motor 150 increases in direct relation with the press conveyor speed. Accordingly, the speed of conveyance of the newspapers between the conveyors 102 and 104 equals or exceeds the speed at which the newspapers are delivered from the press conveyor 14. Each newspaper 12 is ejected from between the terminal rollers 118 of the conveyors 102 and 104 on a trajectory initially coincident with the centerline 106. The newspapers fly a short distance through an open space 156 and are received by elements of the stack delivery section 200.

Stack Delivery Section

The stack formation section 200 basically includes one or more carriage assemblies each generally referenced 202, a carriage transport mechanism generally referenced 204 and a door gate mechanism generally referenced 206, as shown principally in FIGS. 2, 4, 5, 6 and 7. The general function of the carriage assembly 202 is to receive the newspapers supplied from the input delivery section 100 and hold the newspapers as a batch is formed. The general function of the carriage transport mechanism 204 is to move or transport the carriage assembly 202 so that the newspapers delivered serially from the input delivery section 100 will be received one on top of another in a properly formed batch. The general function of the door gate mechanism 206 is to remove the batch of newspapers from the carriage assembly 202 after the batch has been formed, and to thereafter release the batch to fall freely to the stack delivery section 300. The carriage transport mechanism 204 moves the carriage assembly 202 downward through the door gate mechanism 206 to deposit the batch on the door gate mechanism, and thereafter moves the carriage assembly 202 horizontally from beneath the door gate mechanism 206 prior to release by the door gate mechanism of the batch of newspapers.

The carriage transport mechanism 204 is operatively connected to and retained by a stack formation substructure defined in major part by a pair of laterally spaced side plates 208 and 210 which are connected to the frame structure 40. A pair of laterally spaced front walls 212 and 214 are connected to the side plates 208 and 210. When the carriage assembly 202 is positioned for movement along the front walls 212 and 214, a blade apparatus 216 of the carriage assembly 202 normally extends in front of the front walls toward the input delivery section 100 at an angle parallel to the centerline 106 (FIG. 3). A backing plate 218 of the carriage assembly 202 is moved behind the front walls 212 and 214, and a rib element 219 of the blade apparatus 216 extends through the lateral space between the front walls 212 and 214 to operatively connect the blade apparatus 216 to the backing plate 218. A pair of laterally spaced continuous transport bands or chains 220 and 222 are retained in vertically offset rectangular movement paths by chain sprockets *224a*, *224b*, *224c*, *224d* and *226a*, *226b*, *226c* and *226d*, respectively. The chain sprockets *224a–d* and *226a–d* are rotationally connected to the side plates 208 and 210, respectively. The amount of vertical offset of the transport chain movement paths is referenced at 227. A controllable, variable-speed motor 228 is operatively connected through a gear box mechanism 230 and a right angle drive 232 to a shaft 234. Drive chains 236 and 238 supply rotary motion from the shaft 234 to the sprockets *224d* and *226d*. The elements 228, 230, 232 and 234 are retained by the side plates 208 and 210 of the stack formation substructure.

Figure 4:
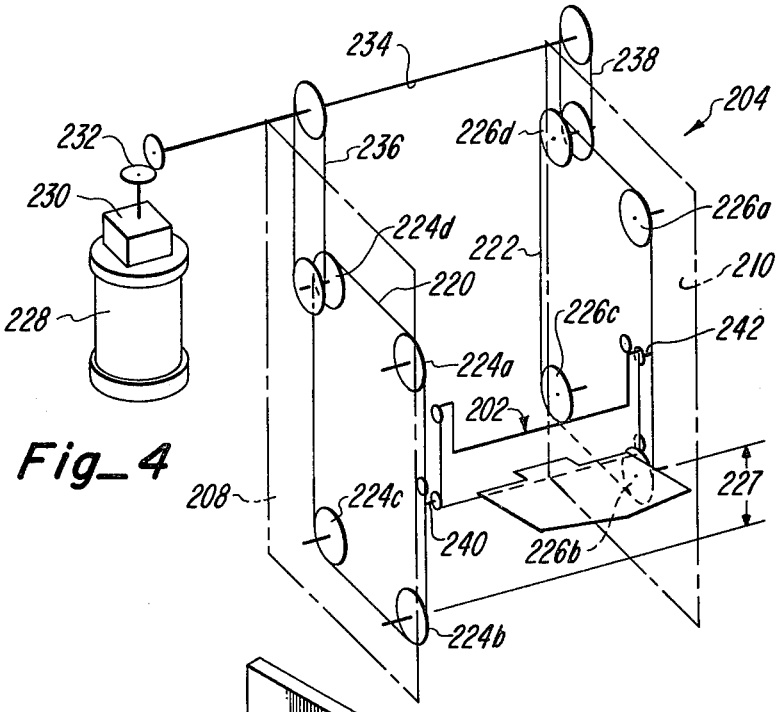
FIG. 4 is a generalized mechanical schematic in perspective of a carriage assembly, a carriage transport assembly and the blade apparatus of the stack formation section of the stack assembly apparatus shown in FIG. 1.

The backing plate 218 of the carriage assembly 202 is connected at a single location by a connection shaft 240 to the transport chain 220. The backing plate 218 is also connected to the transport chain 222 at a single location by another connection shaft 242 on the opposite lateral side of the backing plate. The connection shafts 240 and 242 are vertically offset the same predetermined distance 227 (FIG. 7) that the rectangular movement paths of the transport chains 220 and 222 are vertically offset (FIG. 4). The connection shafts 240 and 242 are connected to links of the chains 220 and 222 respectively at positions to maintain the shafts 240 and 242 within a vertical plane as the transport chains 220 and 222 rotate in their paths and move the carriage assembly 202 in a corresponding rectangular transport movement path.

Figure 5:
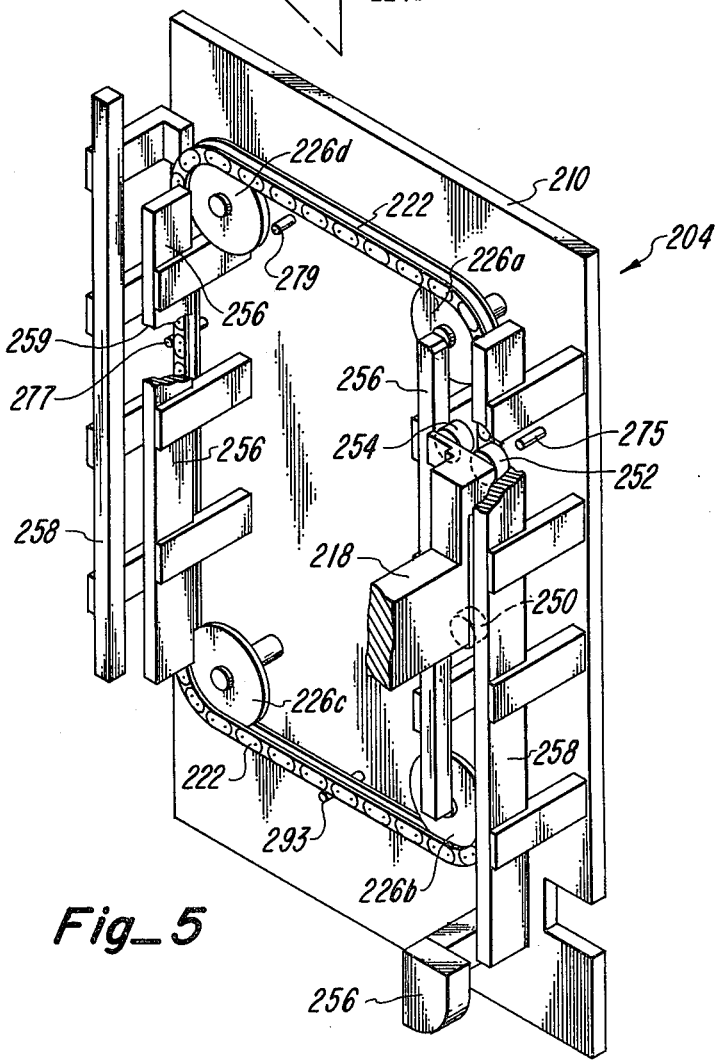
FIG. 5 is an enlarged perspective view of a portion of certain actual elements of the carriage transport assembly, some of which are shown schematically in FIG. 4.

Roller wheels 244, 246 and 248 are rotationally connected in a generally triangular orientation on one lateral side of the backing plate 218. Roller wheels 250, 252 and 254 are rotationally connected on the other lateral side of the backing plate 218 in another generally triangular orientation. The roller wheels 244, 246, 250 and 252 are positioned with their axes of rotation in a common plane parallel to the plane generally defined by the backing plate 218. The roller wheels 248 and 254 are horizontally displaced from the plane of the wheels 244, 246, 250 and 252, and the roller wheels 248 and 254 are vertically displaced from one another. The roller wheels on each lateral side of the backing plate contact and roll between interior and exterior guide track members 256 and 258 respectively (FIG. 5). The interior and exterior guide track members 256 and 258 are connected to each of the side plates 208 and 210 and define a rectangular movement path parallel to the path of the chains 220 and 222 for the wheel groups 244, 246, 248 and 250, 252, 254 on opposite lateral sides of the backing plate 218, respectively. Although one set of interior and exterior guide track members 256 and 258 is illustrated connected to the side plate 210 in FIG. 5, another set of similarly shaped guide track members is connected to the other side plate 208 at a position vertically offset by the same predetermined distance 227. Where necessary, slots 259 are formed through the interior guide track members to allow certain roller wheels to pass therethrough during movement of the carriage assembly over the transport path.

The vertical triangular orientation of the roller wheels on each lateral side of the backing plate moving in contact with the interior and exterior guide track members 256 and 258, and the lateral triangular orientation provided by the roller wheels 244, 252 and 254 and by the roller wheels 246, 248 and 250, and the torsional rigidity of the backing plate 218 causes the carriage assembly 202 to traverse the rectangular transport movement path while maintaining the blade apparatus 216 at approximately the same angular orientation with respect to the horizontal reference and parallel to the centerline 106. The effective result of the vertical and lateral triangular roller wheel orientations is to confine the backing plate 218 within the vertical plane. Even when the weight of the newspapers is added to the blade apparatus 216, the guide track members adjacent the front walls 212 and 214 operatively restrain the carriage assembly 202 against substantial pivoting. The rectangular movement path of the transport chains 220 and 222 and the interior and exterior guide track members 256 and 258 and the triangular orientations of the roller wheels 244–254 on the backing plate 218, is one example of means for securing movement of the carriage assembly 202 in a rectangular or closed figure movement path while maintaining the blade apparatus 216 in a generally consistent angular orientation relative to a horizontal reference.

Figure 6:
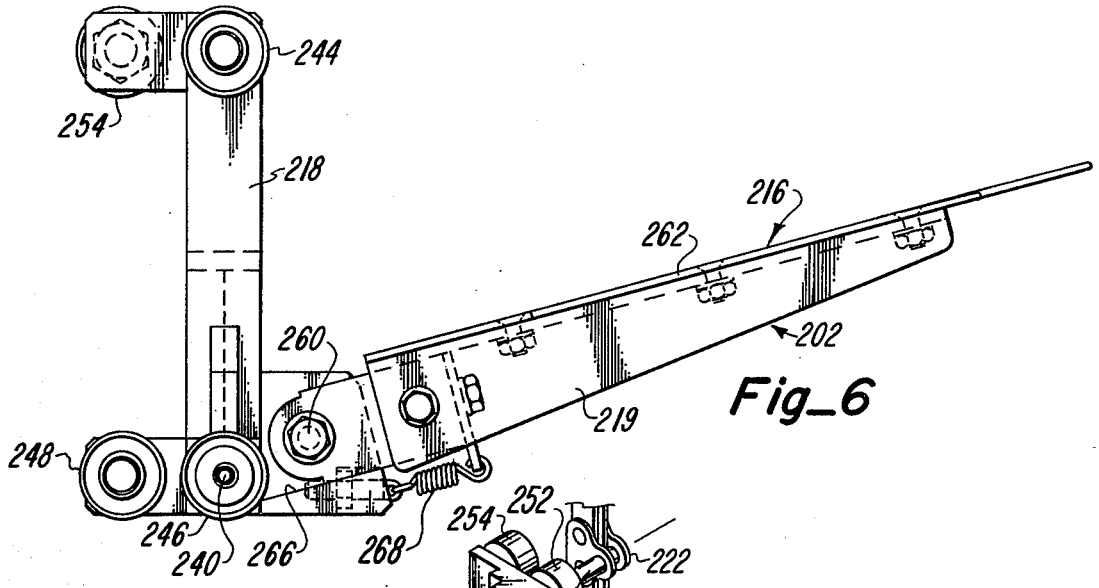
FIG. 6 is an end elevational view of the blade apparatus and its carriage assembly shown in FIGS. 4 and 5.

The blade apparatus 216 is pivotably connected to the backing plate 218, as is shown in FIG. 6, by a pivot pin 260. The blade apparatus 216 includes a generally planar and thin support plate 262 upon which the newspapers are held. The support plate 262 is of substantial size to prevent the edges of the lowermost newspaper resting thereon from drooping a detrimental amount. The center rib 219 is connected to the support plate 262, and the rib element 219 is pivotably connected to the backing plate 218 by the pivot pin 260. One or more stops 266 rigidly connected to the backing plate 218 prevent the blade apparatus 216 from pivoting with respect to the backing plate 218 from its normal support position illustrated further toward horizontal than the predetermined angle parallel to the centerline 106. A spring 268 normally biases and holds the blade apparatus 216 at the angle of the centerline 106. Thus the blade apparatus 216 will maintain its predetermined angular orientation as it traverses the transport movement path due to the vertical orientation of the backing plate maintained at all points along the movement path.

The direction of movement of the carriage assembly 202 is generally clockwise as shown in the drawings. The newspapers are collected on the blade apparatus 216 during the vertically downward movement of the carriage assembly 202 adjacent the front walls 212 and 214. As the carriage assembly 202 moves into position to start its downward movement along the front walls 212 and 214, the outer edge support plate 262 of the blade apparatus 216 contacts a release mechanism 270, as shown in FIG. 3. The release mechanism 270 includes a pivot arm 271 pivotably connected on a shaft 272 to the frame assembly 40. A hook projection 273 extends from one end of the pivot arm 271 for the purpose of contacting the outermost edge of the support plate 262 of the blade apparatus 216. A hydraulic cylinder assembly 274 is operatively connected at the other end of the pivot arm to move the hook projection 273 to intercept the outer edge of the support plate 262 and to pivot the pivot arm and release the support plate 262. The outer edge of the support element 262 is held in a stationary location as the carriage assembly 202 moves a short distance downward after it has initiated its descent. The angle of the blade apparatus 216 increases relative to a horizontal reference to an inclined position until such time as the pivot pin 260 attains a position slightly below an extension of the centerline 106. At this point designated an intercept point, the hydraulic cylinder assembly 274 is operated to move the hook projection 273 out of contact with the edge of the support plate 262. The spring 268 quickly pivots the blade apparatus 216 downward to an intercept position parallel to and slightly below the centerline 106.

Figure 7:
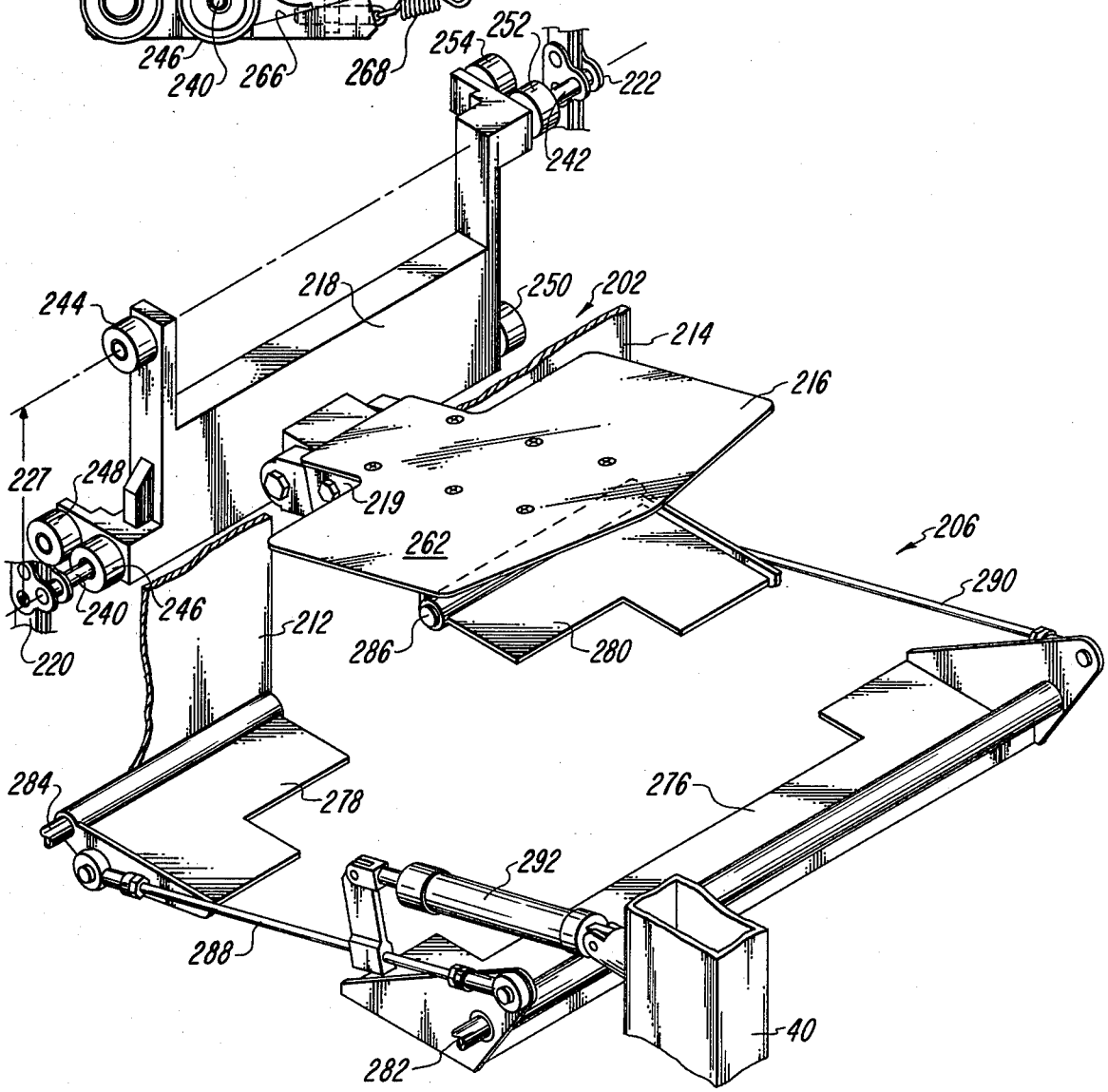
FIG. 7 is a perspective view of the blade apparatus, a door gate mechanism, and portions of front walls of the stack formation section shown in FIGS. 4, 5 and 6.

An intercept sensor or transducer 275 is located at a predetermined stationary position on the side plate 210 (FIG. 5) to sense the proximity of the connection shaft 242 (FIG. 7). When the carriage assembly is properly positioned to allow the blade apparatus to pivot into the intercept position, a signal is supplied from the transducer 275. After receipt of the signal from the transducer 275 and at the appropriate time to intercept the first newspaper of a batch, the hydraulic cylinder assembly 274 operates the release mechanism 270 to release the blade apparatus.

By temporarily holding the outermost edge of the blade assembly upward and releasing it under the force of the spring 268, the blade apparatus 216 quickly moves into position to accurately and completely intercept the first newspaper of a batch. The quick intercepting movement of the blade apparatus avoids the detrimental situations of the first newspaper of the batch incorrectly contacting the blade apparatus 216, or of the last newspaper of the previous batch being included in the next batch. The pivot intercept feature of the blade apparatus 216 assures reliable positioning of the blade apparatus in the proper location at the proper time to precisely intercept the first newspaper of each batch, even when operating at relatively high speeds.

As the blade apparatus 216 moves downwardly, each newspaper after the first newspaper of the batch is received on top of the previous newspaper. The front walls 212 and 214 terminate the forward movement of the newspaper and the parallel angular orientation of the blade apparatus with the newspaper trajectory along the centerline 106 assures that the folded edge of the newspapers abut against the front walls 212 and 214.

The rate of movement of the carriage assembly 202 around the transport movement path is controlled by the speed of the motor 228. The speed of motor 228 is controlled and varied in accordance with the rapidity and presence of newspapers delivered through the input delivery section 100 and in accordance with the position of the next subsequent carriage assembly 202 in the transport path relative to the remaining number of newspapers yet to be added to complete the batch. The objective is to move the next subsequent carriage assembly into the intercept point so the blade apparatus will be in position to pivot into the trajectory of the newspapers delivered from the input delivery section 100 at the precise time to intercept the first newspaper of the new batch and confine the last newspaper to the previous batch. If the carriage assembly is not positioned at the intercept point determined by transducer 275, the blade apparatus cannot move into the intercept position at the proper time. In order to move the carriage to the intercept point in time for the blade apparatus to intercept the first newspaper, a carriage index sensor or proximity transducer 277 and a transport rate sensor or proximity transducer 279 (FIG. 5) are provided. The transducer 277 is attached to the side plate 210 to sense the proximity of the connection shaft 242 (FIG. 7) of the carriage assembly 202 at a predetermined distance advanced in the transport path before the projection shaft reaches the intercept point determined by transducer 275. The transducer 279 is attached to the side plate 210 to sense the rate of passage of teeth in the chain sprocket **226*d*, as shown in FIG. 5. Signals from the counter mechanism 108 determine the number of newspapers which have been delivered to the carriage assembly and the number of newspapers which remain to be delivered. Signals from an input tachometer sensor (not shown in FIGS. 1 through 9, but referenced 412 in FIG. 10) are derived from the motor 150 operating the input delivery conveyors 102 and 104. By knowing the number of newspapers yet to be delivered to complete the batch, the rate at which the newspapers are being delivered, the distance the next subsequent carriage must move to the intercept point, and the rate of movement of the carriage assembly, the rate of movement of the carriage assembly is controlled and varied. The four above mentioned input variable signals are used in solving an empirically derived mathematical formula to operatively control the speed of the transport mechanism motor 228**.

Near a lower position of the downward descent of the carriage assembly, the door gate mechanism 206 contacts the batch of newspapers carried by the blade assembly 216, and the batch of newspapers is removed from the blade assembly 216 and deposited on doors 276, 278 and 280 of the door gate mechanism 206. Once the newspapers have been removed from the blade apparatus 216, the carriage assembly initiates its horizontal movement along the lower leg of the rectangular transport movement path to withdraw the blade apparatus 216 from beneath the door gate mechanism 206.

The door 276 of the gate mechanism 206 is of full lateral width and the doors 278 and 280 are of two partial lateral widths, as is best shown in FIG. 7. The door 276 is pivotably connected on a shaft 282, and the shaft 282 is retained to the frame structure 40. The partial width doors 278 and 280 are pivotably connected on shafts 284 and 286 respectively. The shafts 284 and 286 are connected to the frame structure 40 and are positioned in conjunction with the doors 276 and 278 to provide an open space therebetween in alignment with the open space between the front walls 212 and 214. Accordingly, an open area is available for the rib element 219 of the blade apparatus 216 to move therethrough at the lower positions of the vertical descent of the carriage assembly 202. A connecting rod 288 operatively connects the doors 276 and 278, and another connecting rod 290 operatively connects the doors 276 and 280 for operative opening and closing movement in a clam shell-like manner. A hydraulic cylinder assembly 292 is operatively connected between the connecting rod 288 and the frame structure 40. When the hydraulic cylinder assembly 292 is retracted extended in total length, the doors 276, 278 and 280 are closed and present shelf-like edges extending partially into the space through which the batch of newspapers moves. The shelf-like edges of the doors 276, 278 and 280 contact the marginal side edges of the lowermost newspaper in the batch and are sufficient to support the batch after the blade assembly 216 has moved downward and retracted horizontally from below the doors 276, 278 and 280.

Once the blade assembly 216 has retracted horizontally from beneath the door gate mechanism 206, and the other elements of the stack delivery section 300 are in the proper orientation, which will be described subsequently, the doors 276, 278 and 280 are opened by activating the hydraulic cylinder assembly 292 to a condition of extended total length. The doors 276, 278 and 280 open by pivoting about the axis of the shafts 282, 284 and 286 and release the batch of newspapers. The batch of newspapers previously retained on the doors fall freely and in unison as a group downward into the stack delivery section 300. The signal utilized for controlling the hydraulic cylinder assembly 292 is derived from a door gate proximity sensor or proximity transducer 293, shown in FIG. 5. The transducer 293 is mounted to the side plate 210 at a predetermined position to sense the connection shaft 242 (FIG. 7) when the carriage assembly has reached a horizontal position in the transport path at which the blade apparatus 216 has completely withdrawn from below the doors 278 and 280. Until the transducer 293 supplies its signal, the hydraulic cylinder assembly 292 will not be activated to its extended position to open the doors but will instead be held in its retracted position as shown in FIG. 7 to close the doors.

The simultaneous release of both lateral edges of the lowermost newspaper in the batch by opening the doors 276, 278 and 280 does not fan or otherwise distort any loose edges and cause them to wrinkle or bend as the stack descends into the section 300. All of the pages maintain the flat folded horizontal orientation as they fall after being released by the door gate mechanism 206. In prior art machines which rigidly mount a blade member to a movement chain, the relatively rapid arcuate movement of the outer edges of the blade member as it traverses the curve in the chain track to release the batch causes sufficient air pressure force to distort the lower pages of the newspaper out of their flat folded configuration. Thus, in many prior art machines, the carriage mechanism itself can damage the lower sheets of the lowermost newspaper in the batch by distorting them so that they are wrinkled or torn after the batch terminates its downward freefall movement. The door gate mechanism 206 also provides the advantage of reducing the amount of force generated by the batch upon stopping its freefall movement. The door gate mechanism temporarily stops the downward movement imparted to the batch by the downward moving carriage assembly 202. Once opened, the door gate mechanism causes the stack to begin falling from an initial zero velocity, rather than accelerate from downward velocity of the downward moving carriage assembly. As a result, the free falling batch contacts the elements of the stack delivery section 300 with less momentum and imparts less force to these elements. Lastly, the door gate mechanism 206 provides the added advantage of allowing the release of the batch of newspapers independently of movement of the carriage assembly 202. It is possible to retain the batch on the door gate mechanism 206 for a slight amount of time while a few of the initial newspapers of the next succeeding batch are collecting on the downward moving blade assembly 216 of the next following carriage assembly. In prior art devices where the blade elements are rigidly connected to transport chains, the assembly of a batch on a subsequent blade element must occur simultaneously with the delivery of a previously formed batch, due to unitary movement of the rigidly connected blade elements on the transport chains. The present invention allows certain flexibility in time to accommodate variations in the presence of newspapers supplied on the press conveyor 14 and to allow elements of the stack delivery section 300 to achieve the best operative position before the door gate mechanism 206 releases the assembled batch.

Stack Delivery Section

The stack delivery section 300 generally includes a turntable mechanism 302 operatively positioned directly below the door gate mechanism 206 to receive the free falling batches of newspapers released by the door gate mechanism. The turntable mechanism 302 alternates rotation 180° in the clockwise and counterclockwise directions so each newly received batch of newspapers is rotationally displaced 180° with respect to the previously received batch. In this manner, the folded edges of adjoining batches are positioned on alternate opposite sides of the stack. The resulting stack does not assume a lopsided or curved configuration. Of course, if the articles stacked by the apparatus 10 are not slightly thicker on one side than on the other, as the folded edge 16 of a newspaper is compared to its free edges 18, the turntable mechanism need not be rotated. An ejector mechanism 304 removes a completely assembled stack from the turntable mechanism 302 and ejects the assembled stack onto one or the other of the delivery conveyors 30 or 32. The ejector mechanism 304 is capable of delivering each next assembled stack to an alternate ones of the conveyors 30 or 32 or of delivering all of the assembled stacks to one of the conveyors 30 or 32.

Turntable mechanisms have been employed on prior art stack assembling mechanisms. One such turntable mechanism is disclosed in U.S. Pat. No. 3,599,807, assigned to the assignee of the present invention. All such prior art turntable mechanisms have employed relatively complex and expensive gear box and clutch drive mechanisms for indexing the turntable mechanism one-half of a full turn. The relatively complex nature of such prior art gear box and clutch indexing mechanisms is due to the necessity to quickly rotationally accelerate and decelerate the mass of the turntable mechanism and the newspapers received on the turntable mechanism. The mass of a typical turntable mechanism may approximate fifty pounds and it is not unlikely that the weight of the stack will approach another forty-five pounds. Without the protections which previously have been derived from the prior art gear box and clutch indexing mechanism, the forces generated by quickly accelerating and decelerating a mass of this size tend to quickly destroy or severely wear the components of the turntable mechanism.

Figure 9:
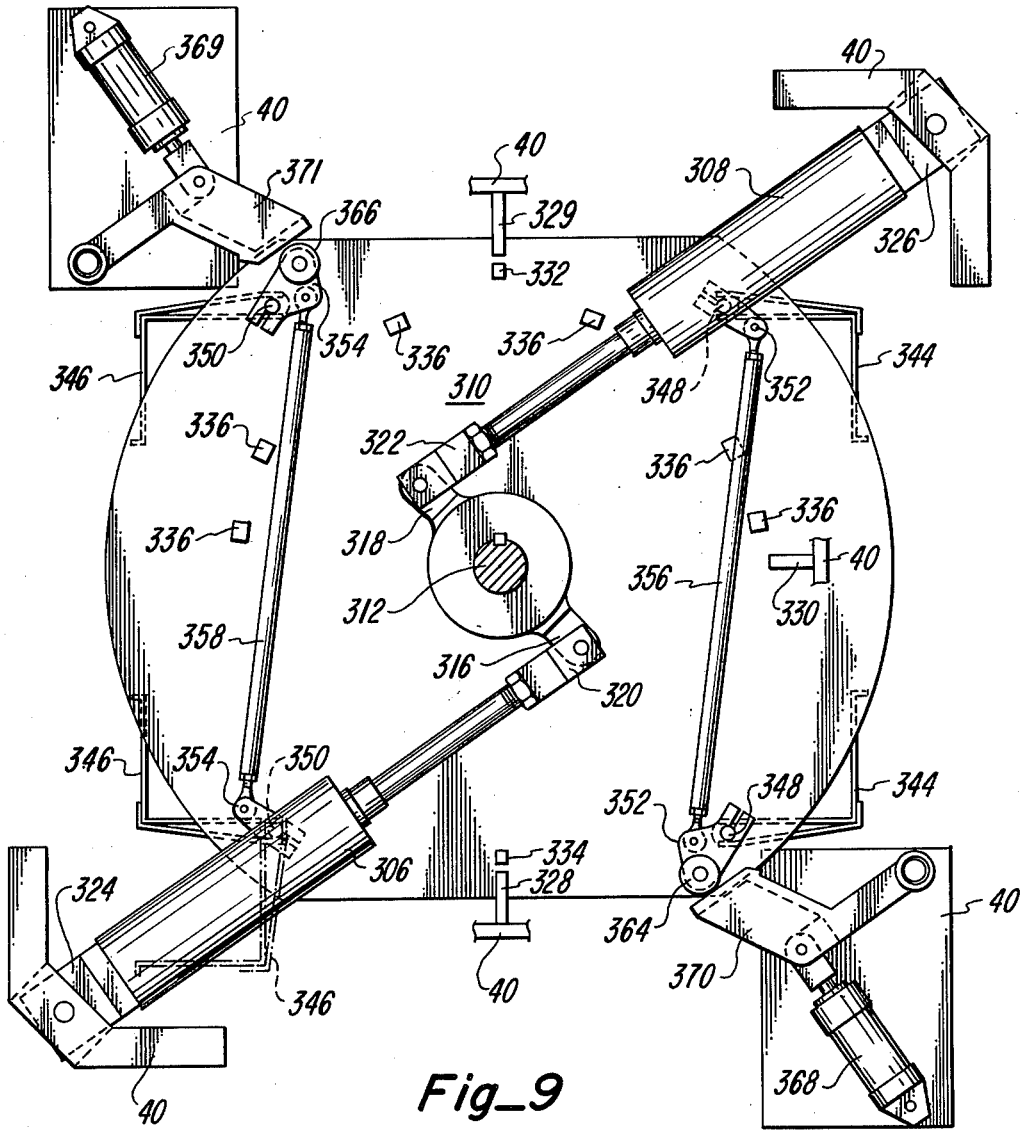
FIG. 9 is a bottom view of the turntable mechanism taken substantially in the plane of line 9—9 of FIG. 8.

One of the significant improvements available from the present invention is the elimination of the gear box and clutch indexing mechanism. As is shown in FIG. 9, the present turntable mechanism 302 utilizes longitudinally extendable hydraulic means such as a drive hydraulic cylinder assembly 306 and a braking hydraulic cylinder assembly 308 to alternatively rotate the turntable mechanism half-turns in opposite directions. The hydraulic cylinder mechanisms 306 and 308 achieve the operational advantages of rapid acceleration and deceleration, but at a fraction of the cost and at a substantial increase in reliability and longevity of operation as compared to the prior art gear box and clutch indexing mechanism.

Figure 8:
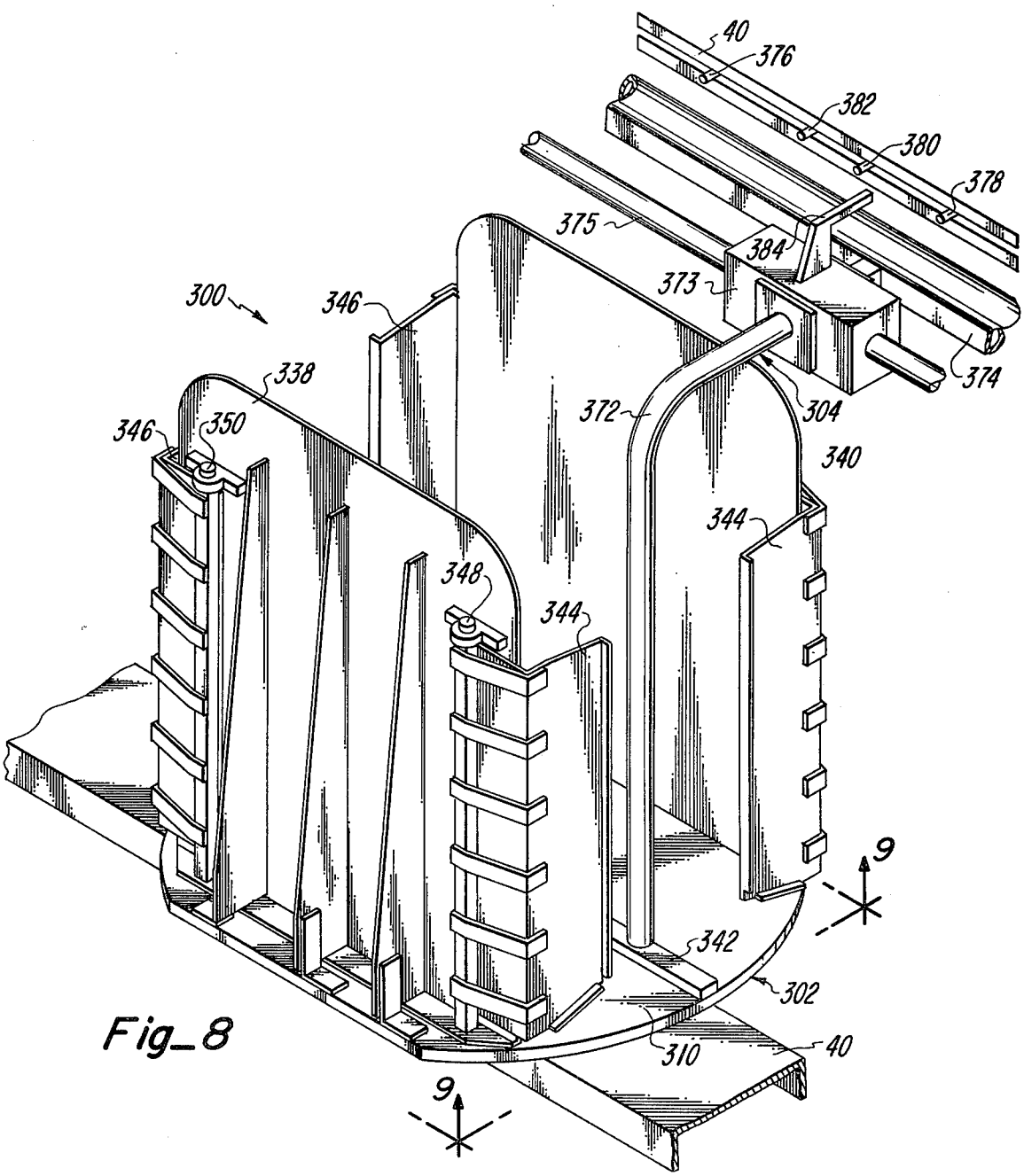
FIG. 8 is a perspective view of a turntable mechanism and ejector mechanism of a stack delivery section of the stack assembly system shown in FIG. 1.

Elements of the stack delivery section 300 are shown principally in FIGS. 2, 8 and 9. The turntable mechanism 302 includes a base plate 310 from which a rigidly connected center shaft 312 extends downwardly. A bearing assembly 314 rotationally connects the shaft 312 to the frame structure 40. A pair of diametrically opposed arms 316 and 318 are fixed to the center shaft 312. The plunger end 320 of the drive hydraulic cylinder assembly 306 is pivotably connected to the arm 316, and the plunger end 322 of the braking hydraulic cylinder assembly 308 is pivotally connected to the arm 318. The cylinder ends 324 and 326 of the hydraulic cylinder assemblies 306 and 308, respectively, are pivotably connected by conventional means to the frame structure 40. Position sensing sensors or proximity transducers 328, 329 and 330 are fixed to the frame structure 40 to sense the condition of rotation of the turntable mechanism. The position transducers 328, 329 and 330 are of the electromagnetic type and respond to the proximity of ferromagnetic materials. A pair of ferromagnetic projections 332 and 334 are attached at diametrically opposite positions to the bottom of the base plate 310. The projections 332 and 334 move into proximity with the position transducers 328 and 329 upon rotation of the turntable mechanism 302 a full half rotation or 180° into one of its two home positions. A plurality of ferromagnetic projections collectively referenced 336 are also attached to the base plate 310 to provide signals from the transducer 330 at various intermediate rotational positions during rotation of the turntable mechanism between the home positions.

The signals derived from the intermediate rotational position transducer 330 are utilized in controlling the drive hydraulic cylinder assembly 306 and braking hydraulic cylinder assembly 308 to provide rapid but smooth acceleration and deceleration of the turntable as it alternately rotates half-turns. Rotation of the turntable 302 begins from one home position. The turntable mechanism 302 will have previously been held in the home position by application of holding force from the drive cylinder assembly 306. To initiate a 180° turn clockwise as shown in FIG. 9, the holding force from the drive cylinder assembly 306 is terminated and rotating force is applied to shorten the overall length of the drive cylinder assembly 306 from the length shown in FIG. 9. The turntable begins to rotate from the home position. During this time no force is applied by the braking cylinder assembly 308. At a predetermined rotational point in the 180° rotation, less than 90° of rotation, the rotating force from the drive cylinder assembly 306 is terminated by signals derived from the movement of one of the projections 336 into proximity with the transducer 330. The momentum imparted to the turntable by the previous application of force from the drive cylinder assembly 306 causes the turntable mechanism to continue rotating past the 90° rotation point. At a predetermined rotational point greater than 90° of rotation but less than 180° of rotation, one of the projections 336 moves into proximity with the position transducer 330 and a signal is supplied for the application of braking force by the braking cylinder assembly 308. The braking force from the braking cylinder assembly 308 begins retarding and decelerating the rotational movement of the turntable mechanism. At the next advanced rotational point somewhat less than 180° of rotation, another projection 336 moves into proximity with the transducer 330 and a signal is supplied for the initiation of holding force by drive cylinder apparatus. The application of holding force assures that the turntable mechanism will move into the other home position 180° rotated from the previous starting home position. In a rotational position after the application of holding force and prior to attainment of the home position, another projection 336 moves into proximity with the transducer 330 and a signal is supplied for removing the retarding force from the braking cylinder assembly 308. Thus, at this position slightly before attainment of the home 180° rotated position, only force from the drive cylinder remains to move and hold the turntable mechanism in the home position. Of course, attainment of the home position is signalled by the proximity of one of the projections 332 or 334 in proximity with the transducer 328.

The turntable mechanism alternatively rotates clockwise and then counterclockwise 180°. The arrangement of the cylinder assemblies 306 and 308 in conjunction with the arms 316 and 318 fully achieve the desired alternate rotation. The use of the two cylinder assemblies 306 and 308 and their position transducers are equally effective as, and provide a potential for greater reliability and longevity of use than, the typical electric drive motor clutch and gear box mechanism utilized in prior art controlled acceleration and velocity rotational indexing devices.

On the upward facing side of the turntable base plate 310, a pair of upstanding side wall members 338 and 340 are connected, as shown in FIG. 8. The batches of newspapers are deposited between the upstanding side wall members 338 and 340. A track member 342 is attached to the upper surface of the base plate 310. The track member 342 is constructed from low friction plastic to facilitate sliding movement of the assembled stack from the turntable mechanism during ejection. The centrifugal force occurring during the rapid rotation of the turntable mechanism may force some of the newspapers toward the open ends between the side walls 338 and 340. To prevent this undesired effect, cooperating pairs of door gates 344 and 346 are pivotably mounted at the open ends between the side wall members 338 and 340. The pair of doors 344 are connected to vertically extending shafts 348, and the pair of doors 346 are connected to vertically extending shafts 350. Pivot arms 352 and 354 are respectively connected to each of the shafts 348 and 350. The pivot arms 352 are connected for movement in unison by connecting rod 356, and the pivot arms 354 are similarly connected for movement in unison by a connecting rod 358. Springs (not shown) bias the connecting rods 356 and 358, respectively, to hold the door pairs 344 and 346 in a normally closed position. Circular bumper members 364 and 366 are respectively attached to the pivot arms 352 and 354. Hydraulic cylinder assemblies 368 and 369 are connected to the frame structure 40, and one of the hydraulic cylinder assemblies 368 or 369 activates its associated contact arm 370 or 371, respectively, to contact one of the bumpers 364 or 366 when the turntable is rotated to one of its home positions. Activation of one of the cylinder assemblies 368 or 369 operatively pivots one of the door pairs 344 or 346 to open. Of course, only the one cylinder assembly 368 or 369 opens a door pair 344 or 346 in the direction of stack ejection at a time. Once the door pairs are opened, the assembled stack is transported off of the turntable mechanism onto one or the other of the delivery conveyors 30 or 32. The nature and operation of the door pairs 344 and 346 is known in the art and is disclosed in U.S. Pat. No. 3,599,807.

The assembled stack is transported off of the turntable mechanism 302 by means of the ejector mechanism 304. Basically, the ejector mechanism 304 comprises an arm 372 operatively connected to a hydraulic rodless air cylinder assembly 374. The cylinder portion of the hydraulic cylinder assembly 374 is retained to the frame structure 40. The arm 372 is connected to a bearing block 373 which slides along a guide 375. The arm 372 moves laterally through the center of the turntable mechanism and through the open spaces between the door pairs 344 and 346 toward and away from the delivery conveyors 30 and 32. The arm 372 is positioned to the lateral side of the turntable mechanism laterally outside of the door pair 344 or 346 opposite to the one delivery conveyor 30 or 32 to which the stack will be ejected, during the time that the stacks are being assembled on the turntable mechanism 302. Once a stack has been assembled, force from the hydraulic cylinder assembly 374 moves the arm 372 from the lateral side position through the space between the one of the door pairs 344 or 346 which is closed and contacts the stack of newspapers. The newspapers slide over the track 342 and off of the turntable from the space between the open pair of the doors 344 or 346 and onto the appropriate one of the delivery conveyors 30 or 32. Once the stack has been ejected, the rodless cylinder assembly 374 holds the arm 372 in the furthest lateral position to which it has just moved and out of the way of the new stack being formed on the turntable mechanism. Once the next subsequent stack has been assembled, the hydraulic cylinder assembly 374 moves the arm 372 in the opposite lateral direction to eject the next assembled stack onto the other one of the output conveyors 30 or 32. In this manner, sequentially assembled stacks are alternatively ejected to the delivery conveyors 30 and 32.

If it is desired to eject each of the assembled stacks to only one of the delivery conveyors 30 or 32, the rodless hydraulic cylinder assembly 374 begins and initiates its ejecting movement from a position on the same lateral side of the turntable mechanism 302. That lateral position is, of course, opposite of the delivery conveyor 30 or 32 to which it is desired to eject all of the stacks. At high operating speeds, an insufficient amount of time exists to move the ejector arm 372 completely across the turntable mechanism and return it to the starting position on the opposite side. In this circumstance, the hydraulic cylinder assembly 374 moves the arm 372 partially across the turntable mechanism but returns it to the starting position without traversing the arm completely across the turntable mechanism.

Position sensors or proximity transducers 376 and 378 are operatively retained to the frame structure 40 at predetermined positions to sense movement and derive signals when the ejector arm 372 reaches its two most lateral side positions. Position sensors or proximity transducers 380 and 382 sense the movement and derive signals when the ejector arm 372 reaches the partial movements position at which its movement is to be reversed. A projection member 384 extends from the bearing block 373 for the purpose of activating the transducers 376, 378, 380 and 382 in accordance with the position of the arm 372. The position transducers 376 and 380 are utilized when the stacks are consistently ejected to the output conveyor 30 to the right as shown in FIG. 8, and the transducers 378 and 382 are utilized when the stacks are consistently ejected on the delivery conveyor 32, to the left as shown in FIG. 8. Signals supplied by the position transducers 376, 378, 380 and 382 operatively control the application of force from the hydraulic cylinder assembly 374.

The ejector cylinder assembly 374 and the ejector arm 372 provide distinct advantages as compared to prior art ejector mechanisms. The typical prior art ejector mechanism involves an endless chain operatively retained in a continuous loop. A pair of arms are rigidly connected to the chain and the chain is rotated in one direction or the other or alternated between directions depending upon the manner in which the stacks are to be ejected. Such a prior art arrangement is relatively complicated and cannot be readily adapted for ejecting assembled stacks from directions perpendicular to the press conveyor 14 to directions parallel to the press conveyor 14. By the present invention, the hydraulic cylinder assembly 374 can be quickly and readily attached to the frame structure 40 in a direction perpendicular to that illustrated in FIG. 8. Furthermore, the turntable mechanism 302 can be rotated 90° to deliver the assembled stacks in perpendicular directions. Since all of the hydraulic assemblies and transducers are connected by flexible hydraulic hoses or by flexible electric connectors, the changing of the positions of the elements noted is easily accomplished.

The movement of the carriage assembly 202 of the stack formation section 200 in the rectangular movement path while maintaining the blade assembly 216 at approximately the same angular orientation with respect to a horizontal reference is a very important feature in allowing the assembled stacks to be ejected in any one of four perpendicular directions. No part of the stack formation section 200 extends into the open space 386 (FIG. 2) to hinder or restrict the ability to eject the stacks in any of the four directions. Of course, the height of the open space 386 is greater than the height of the highest stack to be ejected. Many prior stack assembly mechanisms position certain operative elements in locations which prevent the ejection of the assembled stacks in one or more of the four directions.

Control System

Figure 10:
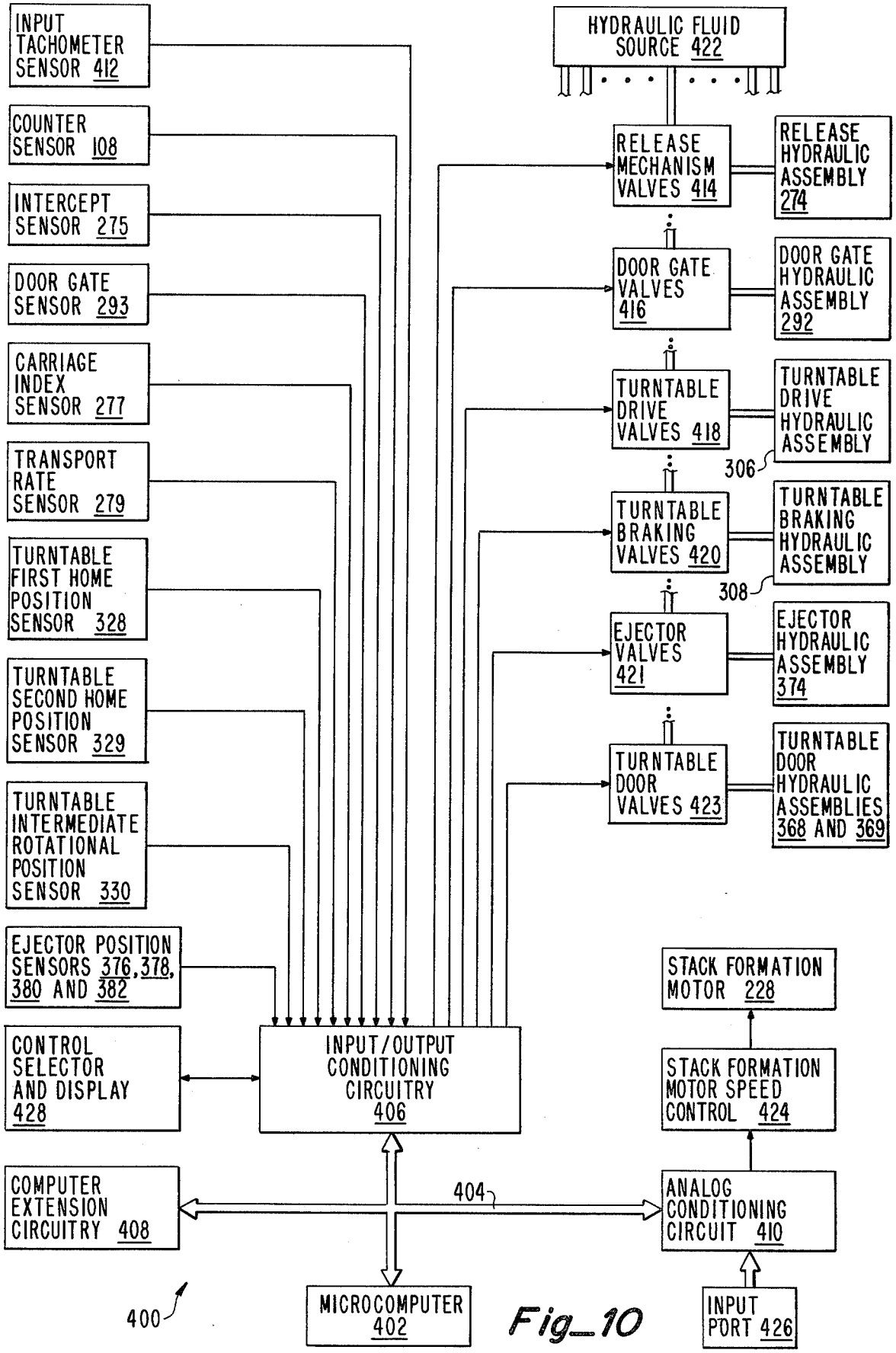
FIG. 10 is a block diagram of a control system for the stack assembly apparatus shown in FIG. 1.

The components of sections 100, 200 and 300 are operatively controlled in the manner previously described by an electronic and hydraulic control system 400 generally shown in FIG. 10. The control system 400 is operatively controlled by a conventional microcomputer 402. The microcomputer 402 is connected over a communication bus 404 to an input-output conditioning circuit 406, an extension circuit 408 and an analog conditioning circuit 410. The common bus 404 carries data, control and address signals between each of the computer elements 402, 406, 408 and 410. The microcomputer 402 is programmed to secure the machine functional operations set forth in the flow diagram of FIG. 11, and others.

Input signals are supplied to the input-output conditioning circuit 406 over conductors extending from an input tachometer sensor 412 which is included within the drive motor 150 of the input delivery section 100, and from the counter sensor 108, the intercept sensor 275, the door gate sensor 293, the carriage index sensor 277, the transport rate sensor 279, the turntable first home position sensor 328, the turntable second home position sensor 329, the turntable intermediate rotational positions sensor 330, and the ejector arm position sensors 376, 378, 380 and 382. The signals supplied by sensors 108 and 412 are derived from the input delivery section 100, the signals from the sensors 275, 293, 277 and 279 are derived from the stack formation section 200, and the signals derived from sensors 328, 329, 330, 376, 378, 380 and 382 are derived from the stack delivery section 300. The input-output conditioning circuit 406 subjects the signals applied to it to appropriate known circuit elements to condition the input signals for compatibility with the digital signals utilized by circuit elements 402, 406, 408 and 410.

In response to the input signals and to the machine function program of the microcomputer, output control signals are delivered to release mechanism valves 414, door gate valves 416, turntable drive valves 418, turntable braking valves 420, ejector valves 421 and turntable door valves 423. The valves 414, 416, 418, 420, 421 and 423 are of conventional construction and are operated by electrical signals delivered over conductors from the conditioning circuit 406. A plurality of single valves may be involved in each of the components 414, 416, 418, 420, 421 and 423 to secure operation of the hydraulic assemblies 274, 292, 306, 308, 374, 368 and 369, respectively, in both longitudinally extendable directions. When activated, each of the valves 414, 416, 418, 420, 421 and 423 conducts hydraulic fluid from a source 422 to the hydraulic assemblies which the valves respectively operate. The hydraulic fluid source 422 is conventional and is secured by operation of a motor driven hydraulic pump, for example. Preferably the hydraulic system originating with the source 422 is pneumatic and air pressures operate the hydraulic assemblies of the apparatus 10.

The motor 228 of the stack formation section 200 is operatively controlled by a motor speed control 424.

The motor speed control 424 is of conventional construction and responds to analog signals supplied thereto by the analog conditioning circuit 410. The primary function of the analog conditioning circuit 410 is to convert the computer generated digital motor speed signals present on the bus 404 to analog signals and supply them to the motor speed control 424. An input port 426 is also operative in conjunction with the analog conditioning circuit 410. The function of the input port 426 is to allow the machine operating program to be loaded into the memory of microcomputer 402 from an external source.

The computer extension circuit 408 includes extra programmable and random access memory for use in executing machine operating program. The computer extension circuit 408 includes input and output data latches for storing input and output digital signals until such time as the program of the microcomputer 402 can address and utilize the data held by the data latches in the extension circuit 408. In addition, timing and counting circuit elements and circuits allowing for adjustments in the operational rate of many of the mechanical components are present in the extension circuit 408. After an initial break-in period of use, many of the mechanical components of the apparatus 10 will operate at slightly different speeds. The adjustment circuits of the circuit 408 allow for such changes in operating speed due to wear and the like. The extension circuit 408 also includes elements which check the proper operation of the microcomputer 402 and also interrupt the execution of the program of the microcomputer and substitute certain interrupt subroutines upon the detection of some critical function of the apparatus 10 which needs immediate servicing.

An input control selector and display 428 is provided to allow operator selection of certain functions available from the control system 400. The input selector 428 includes circuit elements which allow the operator to select the number of newspapers to be included in each stack, and the number of batches to be assembled in each stack. The path of stack ejection can also be selected. Other types of controls as would be typical in the particular type of field to which the apparatus 10 relates may also be included. The input control selector 428 also includes appropriate visual and audible signalling devices or alarms to indicate or display the status and nature of operation of the apparatus 10.

Figure 11:
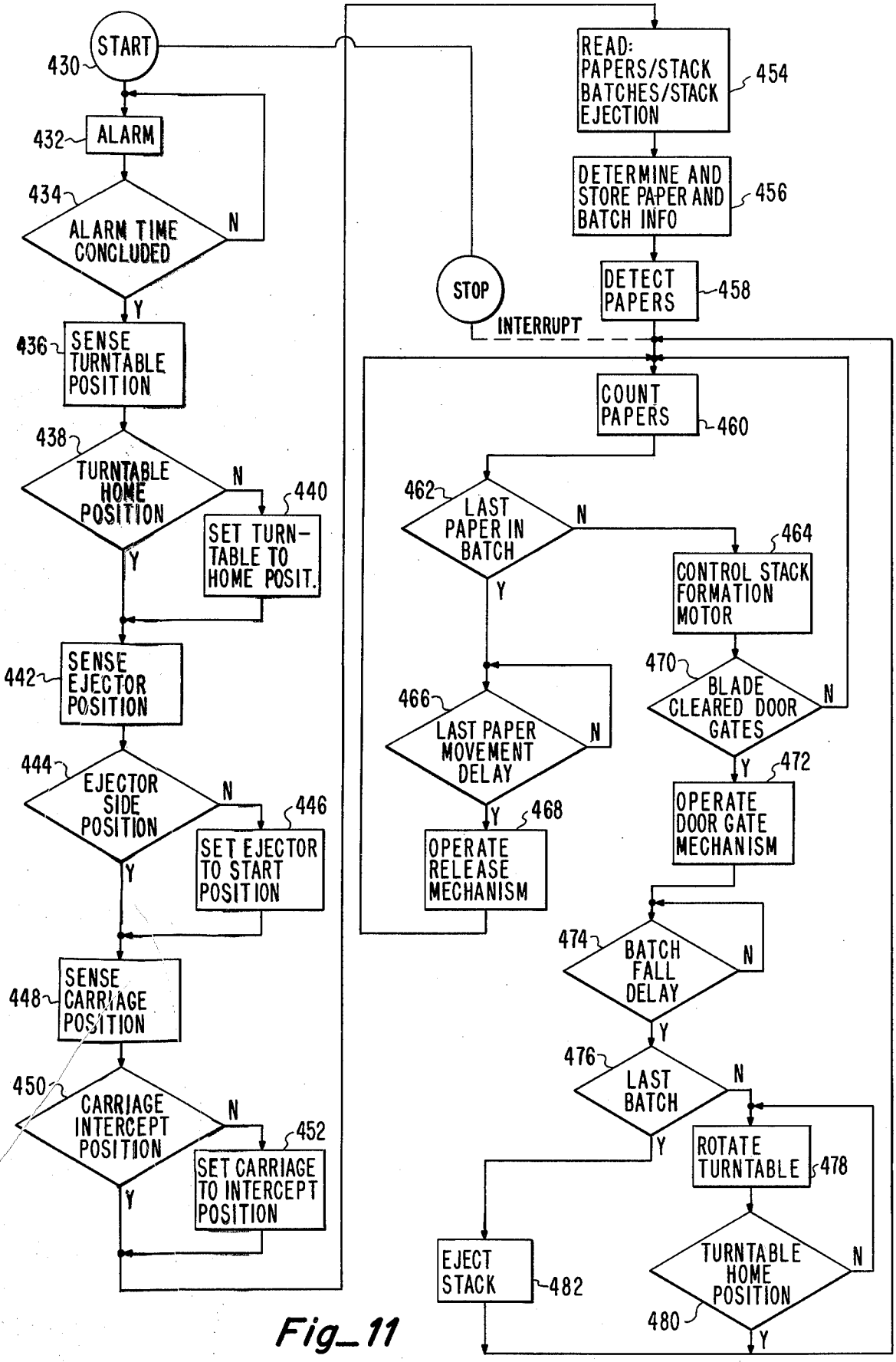
FIG. 11 is a flow diagram of the operation of the control system and functions of the stack assembly apparatus.

The nature of operative control over the apparatus 10 by the control system 400 is understood by reference to FIG. 11 in conjunction with FIG. 10. Upon initially starting the operation of the stack assembling apparatus and before any movement of its mechanical elements, as referenced at 430, an alarm is provided from the display 428 for a predetermined time period. The alarm state is indicated at 432. Upon determining that the predetermined time period of the alarm has terminated, as is referenced at 434, the position of the turntable is sensed by determining the presence or absence of signals from the sensors 328 and 329, as is referenced at 436. If the turntable mechanism does not occupy one of the first or second home positions, as determined at 438, signals are delivered to one or the other of the turntable valves 418 and 420 to move the turntable mechanism into one of the first or second home positions, as is referenced at 440. The position of the ejector arm is sensed by the presence or absence of signals from sensors 376 or 378, as referenced at 442, after the turntable mechanism has attained one of its home positions. If the ejector arm is not in one of the start positions as determined at 444, signals are delivered to the ejector valves 421 to cause the hydraulic assembly 374 to move the ejector arm to its lateral side starting position, as referenced at 446. The position of the carriage is sensed at 448 by the presence or absence of a signal from sensor 275, after the ejector arm has been properly positioned. If the carriage is not located in its proper intercept position, as determined at 450, signals are delivered from the analog conditioning circuit 410 to the motor speed control 424, and the motor 228 moves the transport assembly to properly position the carriage in the intercept position, as is indicated at 452.

With the turntable mechanism, the ejector arm and the carriage means positioned in their start positions, information pertaining to the number of newspapers per stack, the number of batches per stack and the ejector direction information is received from the control selector 428 and read into the computer as is referenced at 454. The computer performs the mathematics necessary to determine the number of articles per batch and the placement of any remaining newspapers to secure the selected number of newspapers per stack, as is referenced at 456, and stores this mathematical information in the memory of the microcomputer. In this condition, the apparatus 10 is ready to receive the newspapers and begin the process of assembling the newspapers into stacks.

Newspapers passing through and conveyed by the input conveyor section 100 are detected as referenced at 458 by the count sensor 108. The signals from the count sensor 108 are employed to count the newspapers as referenced at 460. As the newspapers are counted, the count is compared at 462 with the selected number of newspapers forming a batch, as established at step 456. Until the last paper in the batch is reached, the speed of the stack formation motor 228 is controlled as referenced at 464 by the signals from the carriage index sensor 277, the transport rate sensor 279, the input tachometer sensor 412, the counter sensor 108 and the intercept sensor 275. These signals are processed by the microcomputer in accordance with their empirically derived interrelationship to position the blade apparatus 216 of the subsequent carriage assembly 202 at the intercept position with the blade apparatus 216 properly poised by the release mechanism 270 to intercept the first newspaper of the next batch. When the last newspaper of the batch is detected at 462, a time delay 466 is activated to compensate for the transit time of the last newspaper in the batch between the counter mechanism 108 and the position at which it cannot be intercepted by the blade apparatus 216. At the end of this time delay, the release mechanism is released as is referenced at 468. After the release mechanism is operated, the papers of the new batch are counted, as referenced at 460.

The carriage assembly 202 supporting the previously formed batch continues its movement and ultimately deposits the previously formed batch of newspapers on the door gate mechanism 206. After the newspapers have been transferred to the door gate mechanism, the door gate sensor 293 provides signals so that the withdrawal of the blade apparatus from beneath the door gate mechanism can be determined at 470. Until such time as the blade apparatus has withdrawn from beneath the door gate mechanism, the newspaper count will continue at 460. Once the blade apparatus has cleared the door gate mechanism, the doors are released as referenced at 472 by supplying signals to the door gate valves 416 which control the assembly 292. A time delay at 474 is activated to allow the batch sufficient time to fall freely to the turntable mechanism 302. Once the batch time delay has occurred, it is determined if the batch just released is the last batch of the stack, as referenced at 476. If not, the turntable mechanism is rotated as referenced at 478 by sending signals to the turntable valves 418 and 420. The turntable is rotated with the aid of the signals delivered from the sensors 228, 229 and 230. Once one of the first or second home positions of the turntable is attained, as referenced at 480, the operation of the system continues counting newspapers at 460. If, however, the last batch of each stack is reached, as is referenced at 476, the stack is ejected as is referenced at 482. The turntable door valves 423 are signalled and one of the assemblies 368 or 369 opens one of the door pairs 344 or 346, and ejector valves 421 are signalled to operate the ejector hydraulic assembly 374, in accordance with the signals available from the ejector sensors 376, 378, 380 and 382 and the control functions selected at 428.

The control system 400 thereby exercises operative machine control over the elements of the stack handling apparatus 10 to secure the numerous significant advantages and improvements which have been described in detail. Although the preferred embodiment has been described with a degree of specificity, the preferred embodiment is but one example of the present invention. The invention itself is defined by the scope of the appended claims.

What is claimed is:

1. Apparatus for assembling a stack of flat sheet-like articles from a stream of said articles, comprising:

input delivery means receptive of the stream of articles and for serially conveying and delivering each of said articles into a free space within said apparatus in a generally planar manner along a predetermined trajectory;

formation means receptive of the articles delivered into the free space along the predetermined trajectory and for forming a predetermined number of said articles into a layered batch, said formation means comprising: carriage means including a generally planar support surface element upon which to support the lowermost article in each batch as the batch is formed, and transport means operatively connected for moving said carriage means in a closed figure movement path while maintaining the support surface element at a predetermined angle throughout movement in the closed figure path, the support surface element of said carriage means moving through the free space during a portion of the movement of the carriage means in the closed figure movement path;

stack delivery means receptive of the batches of articles and for assembling a predetermined number of batches into the stack of articles, the predetermined number of batches in a stack being at least one; and wherein said formation means further comprises door gate means for operatively removing the batch of articles from the support surface element of said carriage means during movement of said carriage means in the movement path, said door gate means further selectively releasing each removed batch for free fall movement to said stack delivery means.

2. Apparatus as defined in claim 1 wherein each batch of articles is removed from the support surface element to said door gate means by transfer resulting from movement of said carriage means relative to the door gate means.

3. Apparatus for assembling a stack of flat sheet-like articles from a stream of articles, comprising:

input delivery means receptive of the stream of articles and for serially conveying and delivering each of said articles into a free space within said apparatus in a generally planar manner along a predetermined trajectory;

formation means receptive of the articles delivered into the free space along the predetermined trajectory and for forming a predetermined number of said articles into a layered batch, said formation means comprising: carriage means including a generally planar support surface element upon which to support the lowermost article in each batch, and transport means operatively connected for moving the support surface element of said carriage means generally downward through the free space, and door gate means for operatively removing the batch of articles from the support surface element of said carriage means by transfer resulting from movement of said carriage means relative to said door gate means, said door gate means further selectively releasing each batch transferred thereto for free fall movement; and stack delivery means operatively positioned below said door gate means to receive each free falling batch and for assembling a predetermined number of batches into the stack of articles, the predetermined number of batches in a stack being at least one.

4. Apparatus as defined in claims 1, 2, or 3 wherein said transport means withdraws the support surface element generally horizontally from beneath the free fall path of each batch beneath the door gate means, after operative removal of each batch from the support surface element by the door gate means.

5. Apparatus as defined in claim 4 wherein said stack delivery means further includes ejector means for ejecting assembled stacks therefrom, and said formation means is positioned above said stack delivery means to define a predetermined open space between said formation means and said stack delivery means which is greater in vertical height than the height of the stack of articles, and said transport means confines said carriage means to locations spaced above the predetermined vertical open space, and the predetermined open space is unobstructed to allow ejection of the assembled stacks any one of four directions along two mutually perpendicular ejection paths from said stack delivery means.

6. Apparatus as defined in claim 5 wherein said stack delivery means further comprises turntable means receptive of each free falling batch and for rotating the articles received a predetermined amount after each additional batch is received, said turntable means comprising a rotationally mounted turntable base, and means operative for longitudinally extendable movement, said longitudinally extendable movement means operatively connected to said turntable base eccentrically with respect to the rotational axis of the turntable base.

7. Apparatus as defined in claims 1 or 3 wherein said carriage means further comprises means operatively connecting said support surface element for pivoting a predetermined limited amount from a support position generally parallel with an initial portion of the predetermined trajectory to an angularly inclined position at which said support surface element is angularly inclined with respect to the support position, and means normally biasing said support surface element to the support position; and said formation means further comprises intercept control means for operatively pivoting the support surface element to the inclined position and for thereafter releasing the support surface element to pivot into and attain its support position at a predetermined location of movement of said carriage means at which the support surface element is in position to receive the first article of the batch delivered into the free space.

8. Apparatus as recited in claim 7 wherein said intercept control means comprises a releasable hook mechanism operatively positioned to engage an edge of said support surface element at an initial location in the movement path of said support surface element through the free space.

9. Apparatus as recited in claims 2 or 3 wherein said door gate means comprises a pair of separated pivotable doors operatively positioned to engage opposite edges of the lowermost article from beneath the batch, and means operatively pivoting the doors in a clam-shell manner from beneath the opposite edges of the batch.

10. Apparatus as recited in claims 1 or 3 wherein said input delivery means comprises a pair of spaced apart conveyor means for conveying the articles along a centerline intermediate the pair of conveyor means, and means operatively connected for simultaneously moving each of the conveyor means equal distances toward and away from the centerline.

11. Apparatus as recited in claims 1 or 3 wherein said transport means comprises a pair of spaced endless transport band means, each transport band means movably retained in a closed loop movement path of the same predetermined configuration, each movement path extending within a plane and the planes of the movement paths extending parallel to one another, the two movement path configurations being offset from one another at all points therealong by a predetermined amount in a predetermined dimension within the planes of the movement paths; and said carriage means comprises a backing member operatively connected at one lateral side to a single point on one transport band means and operatively connected at the other lateral side to a single point on the other transport band means, the opposite single connection points being offset in the predetermined dimension by the same predetermined amount as said movement paths are offset.

12. Apparatus for conveying flat sheet-like articles, comprising:

a pair of spaced apart conveyor means for advancing the articles in a planar conveying path along a centerline between the pair of conveyor means;

a first conveyor portion of one of said conveyor means operatively positioned on one lateral side of the centerline and a second conveyor portion of the other of said conveyor means operatively positioned on the other lateral side of the centerline directly across from the first conveyor portion;

each conveyor portion including a first roller and a second roller positioned following the first roller in the conveying path; and means operatively connecting the rollers of the first and second conveyor portions for moving the two first rollers equidistantly toward and away from one another with respect to the centerline and for simultaneously moving the two second rollers equidistantly toward and away from one another with respect to the centerline, said means for moving said rollers including a scissors assembly, and said scissors assembly comprising:

a first pair of pivot arms pivotably connected to one another at a pivot point coincident with the centerline and laterally displaced to one side of the conveying path;

a second pair of pivot arms pivotably connected to one another at a pivot point coincident with the centerline and laterally displaced to one side of the conveying path;

said first roller of said first conveyor portion and the second roller of said second roller connected to one of the pivot arms of the first and second pairs of pivot arms at positions on opposite sides of the pivot point;

said second roller of said first conveyor portion and the first roller of said second roller connected to the other of the pivot arms of the first and second pairs of pivot arms at positions on opposite sides of the pivot point; and means operatively interconnecting at least one pair of pivotably connected pivot arms for operatively pivoting said one pair of pivot arms about the pivot point.

13. Apparatus as defined in claim 12 wherein said scissors assembly operatively moves all four rollers the same distance toward and away from the centerline.

14. Apparatus for assembling stacks of flat sheet-like articles from a stream of said articles comprising:

input delivery means receptive of the stream of articles and for serially conveying and delivering each of said articles into a free space within said apparatus in a generally planar manner along a predetermined trajectory; said input delivery means comprising a pair of conveyor segments spaced on opposite vertical sides of a centerline along which said input delivery means conveys said articles, and means operatively connecting the pair of conveyor segments for moving the pair of conveyor segments equidistantly toward and away from the centerline;

formation means receptive of the articles delivered into the free space along the predetermined trajectory and for forming a predetermined number of articles into a layered batch; said formation means comprising carriage means including a backing member and a support surface element pivotably connected to the backing member, and transport means operatively connected for moving said carriage means in a closed figure movement path, said transport means comprising a pair of spaced endless transport bands, each transport band movably retained in a closed loop movement path of the same predetermined configuration, each transport band movement path generally extending within a vertical plane, and the two transport band movement path configurations being vertically offset from one another by a predetermined amount, the backing member of said carriage means operatively connected at one lateral side to a single point on one transport band and operatively connected at the other lateral side to a single point on the other transport band, the opposite single connection points vertically offset from one another by the same predetermined amount as said transport band movement paths are offset, said support surface element normally occupying a support position generally parallel with the centerline of the input delivery means and otherwise occupying an angularly inclined position at which said support surface element is angularly inclined with respect to the centerline, said carriage means further comprising means normally biasing said support surface element to maintain the support position;

intercept control means for operatively initially pivoting the support surface element to the inclined position and for thereafter releasing the support surface element to pivot into and attain the support position at a predetermined location of movement of the carriage means at which the support surface element is in position to receive the first article of the batch delivered into the free space;

door gate means for operatively removing the batch of articles from the support surface element of said carriage means and transferring the removed batch to the door gate means during movement in the movement path, said door gate means further selectively releasing each batch transferred thereto for downward free fall movement, said door gate means comprising a pair of horizontally displaced pivotable doors operatively positioned to engage opposite edges of the lowermost article in the batch and means operatively opening and closing the doors in a clam-shell manner; and stack delivery means operatively positioned vertically below said door gate means to receive each free falling batch and for assembling a predetermined number of batches into a stack of articles; said stack delivery means comprising a turntable operative for receiving each free falling batch and for rotating the articles received a predetermined amount after each additional batch is received, hydraulic means operative for longitudinally extendable movement between a stationary point and a point on said turntable eccentrically positioned with respect to a rotational axis of said turntable, and control means for controlling the application of force to secure longitudinal movement of said hydraulic means to initiate and accelerate rotation of the turntable from a first home position toward a second home position 180° rotationally displaced from the first home position, and to thereafter initiate and decelerate the rotation of the turntable prior to the turntable attaining the second home position, and to lastly hold the turntable in the second home position after the turntable has attained the second home position; and said stack delivery means further comprising ejector means for ejecting the assembled stack from said turntable means.

15. An invention as recited in claim 14 wherein said control means operatively controls the application of force for rotating the turntable as follows:

applies accelerating force over a rotational arc of the turntable beginning at the first home position and extending to a rotational position no greater than 90° of rotation away from the first home position, applies decelerating force over a rotational arc of the turntable beginning at a rotational position no greater than 90° of rotation before the second home position and extending to a rotational position no greater than the second home position, and applies holding force to urge the turntable to the second home position beginning at a rotational position after the application of decelerating force and continues the holding force after the turntable has attained the second home position.

16. An invention as recited in claim 15 wherein said control means further operatively controls the application of force for rotating the turntable as follows:

terminates the application of accelerating force at a rotational position less than 90° of rotation away from the first home position, begins the application of decelerating force at a rotational position less than 90° of rotation before the second home position, and allows rotational momentum to carry the turntable through the rotational arc between the points of termination of the accelerating force and application of the decelerating force.

17. Apparatus for conveying a plurality of flat sheet-like articles such as newspapers along a predetermined centerline and counting each of said articles as it passes along the centerline, said apparatus selectively gripping the articles for advancement along the centerline without substantially distorting the position of a leading edge of each of the articles relative to the centerline to improvedly actuate a counter mechanism which signals a count of the articles conveyed, said apparatus comprising, in combination:

a pair of spaced apart conveyor means for advancing the articles in a planar conveying path along the centerline between the pair of conveyor means;

a first conveyor portion of one of said conveyor means operatively retained on one lateral side of the centerline and a second conveyor portion of said conveyor means operatively retained on the other lateral side of the centerline directly across from the first conveyor portion;

a counter mechanism including trigger means operatively retained relative to said first and second conveyor portions, said trigger means operatively occupying a substantially fixed position relative to the centerline to encounter the leading edge of each article conveyed, said trigger means activating said counter means to signal the passage of each said article conveyed;

each conveyor portion including a first roller and a second roller positioned following the first roller in the conveying path; and means operatively connecting the rollers of the first and second conveyor portions for moving the two first rollers equidistantly toward and away from one another with respect to the centerline and for simultaneously moving the two second rollers equidistantly toward and away from one another with respect to the centerline to maintain the leading edge of each article conveyed in a fixed predetermined position relative to the centerline for more reliably encountering the trigger means of said counter mechanism.

18. Apparatus as defined in claim 17 wherein said means for moving said rollers operatively moves all four rollers the same distance toward and away from the centerline.

19. Apparatus as defined in claim 17 wherein said trigger means of said counter mechanism is operatively positioned intermediate the first and second rollers of one of said conveyor portions.

* * * * *